US011939785B1

(12) United States Patent
Urhausen et al.

(10) Patent No.: US 11,939,785 B1
(45) Date of Patent: Mar. 26, 2024

(54) RAPID-DEPLOYMENT SHELTER

(71) Applicant: DLX Enterprises, LLC, Eugene, OR (US)

(72) Inventors: Jonathan Urhausen, Eugene, OR (US); Adam Barr, Eugene, OR (US); Donald Bierman, Eugene, OR (US)

(73) Assignee: DLX Enterprises, LLC, Eugene, OR (US)

( * ) Notice: Subject to any disclaimer, the term of this patent is extended or adjusted under 35 U.S.C. 154(b) by 0 days.

(21) Appl. No.: 17/857,732

(22) Filed: Jul. 5, 2022

Related U.S. Application Data

(63) Continuation of application No. 17/677,210, filed on Feb. 22, 2022, now Pat. No. 11,898,366, which is a continuation of application No. 16/861,012, filed on Apr. 28, 2020, now Pat. No. 11,280,107, which is a continuation-in-part of application No. 16/431,322, filed on Jun. 4, 2019, now Pat. No. 10,941,559, which (Continued)

(51) Int. Cl.

| | |
|---|---|
| ***E04H 15/10*** | (2006.01) |
| ***E04B 1/19*** | (2006.01) |
| ***E04H 15/18*** | (2006.01) |
| ***E04H 15/36*** | (2006.01) |
| ***E04H 15/44*** | (2006.01) |
| ***E04H 15/50*** | (2006.01) |
| ***E04H 15/54*** | (2006.01) |
| ***E04H 15/58*** | (2006.01) |

(52) U.S. Cl.

CPC ..... *E04H 15/18* (2013.01); *E04B 1/1903* (2013.01); *E04H 15/10* (2013.01); *E04H 15/36* (2013.01); *E04H 15/44* (2013.01); *E04H 15/50* (2013.01); *E04H 15/54* (2013.01); *E04H 15/58* (2013.01); *E04B 2001/1927* (2013.01); *E04B 2001/1957* (2013.01)

(58) Field of Classification Search

CPC ..... E04H 15/18; E04H 15/10; E04H 15/36; E04H 15/44; E04H 15/50; E04H 15/54; E04H 15/58; E04H 2015/207

USPC ..... 135/97, 124, 143, 157, 158, 160, 115, 135/117, 908

See application file for complete search history.

(56) References Cited

U.S. PATENT DOCUMENTS 2,448,895 A * 9/1948 Lawrence ..... E04H 15/44 135/159

3,559,353 A 2/1971 Partridge (Continued)

FOREIGN PATENT DOCUMENTS

CA 2837116 11/2012

DE 29510827 9/1995

(Continued)

*Primary Examiner* — Robert Canfield

(74) *Attorney, Agent, or Firm* — MacCord Mason PLLC

(57) ABSTRACT

A shelter system is shown and described. A hub for a shelter system is shown and described. A frame for a shelter system is shown and described. In one embodiment, the shelter system includes a frame and cover. The shelter may include a hub system. The frame may be collapsible. The cover is configured to fit with the frame. The hub may include a receiver slot, a receiver sleeve and an attachment projection. The result is a shelter system with reduced set up time, effort and requirements and improved strength and ease of use. The inventions may also be considered a shelter kit and/or a shelter and hub method.

18 Claims, 30 Drawing Sheets

Related U.S. Application Data is a continuation of application No. 15/639,261, filed on Jun. 30, 2017, now Pat. No. 10,309,093.

(60) Provisional application No. 62/356,793, filed on Jun. 30, 2016.

(56) References Cited

U.S. PATENT DOCUMENTS 3,670,747 A * 6/1972 Pohl ..... E04H 15/00 135/156
3,929,146 A 12/1975 Maiken
3,955,328 A 5/1976 Lindsay
3,970,096 A * 7/1976 Nicolai ..... E04H 15/14 135/117
4,165,757 A * 8/1979 Marks ..... E04H 15/14 135/93
4,373,305 A 2/1983 Russell
4,649,947 A 3/1987 Tury
4,658,560 A 4/1987 Beaulieu
4,667,692 A * 5/1987 Tury ..... E04H 15/505 52/109
4,689,932 A 9/1987 Zeiglar
4,706,696 A 11/1987 Gillis
4,846,204 A 7/1989 Sok Kyu
4,886,084 A 12/1989 Lawrence
4,945,936 A 8/1990 Surrendi
4,953,329 A 9/1990 Franti
4,995,212 A 2/1991 Morgan
5,017,068 A 5/1991 Cooksey
5,069,572 A 12/1991 Niksic
5,159,948 A 11/1992 Moreau
5,394,897 A 3/1995 Ritchey
5,634,483 A 6/1997 Gwin
5,638,848 A * 6/1997 November ..... E04H 15/42 135/900
5,666,986 A 9/1997 Fox
5,943,837 A 8/1999 Esser
6,141,934 A 11/2000 Zeiglar
6,145,525 A 11/2000 Mooney
6,223,482 B1 5/2001 Zahar
D454,609 S 3/2002 Meyerhoffer et al.
6,553,698 B1 4/2003 Kemeny
6,553,699 B2 4/2003 Kemeny
6,554,013 B2 * 4/2003 Brown ..... E04H 1/1277 135/156
6,679,009 B2 * 1/2004 Hotes ..... E04H 15/36 135/92
6,758,354 B2 7/2004 Carletti
6,772,780 B2 8/2004 Price
6,802,329 B2 10/2004 Chen
7,131,236 B2 11/2006 Sample
D544,941 S 6/2007 Rogers
7,533,498 B2 5/2009 Zeigler
7,556,054 B2 7/2009 Zeigler
7,578,306 B2 * 8/2009 Mettavant ..... E04H 15/16 135/156
8,082,938 B2 12/2011 Prusmack
D652,885 S 1/2012 Frey
8,360,085 B2 1/2013 Lee
8,381,454 B1 2/2013 Robinson
8,448,656 B2 5/2013 Choi
8,496,019 B2 7/2013 Zhou
8,549,794 B2 * 10/2013 Hotes ..... E04H 15/16 52/63
8,925,565 B2 1/2015 Choi
9,103,137 B2 8/2015 Williams
9,163,425 B1 10/2015 Kubica
9,212,503 B1 * 12/2015 Mentch ..... A01G 9/22
9,243,423 B2 1/2016 Jin
9,243,424 B2 1/2016 Jin
9,441,394 B1 * 9/2016 Hotes ..... E04H 15/54
9,470,010 B2 10/2016 Woong
9,605,441 B2 3/2017 Choi
9,631,393 B2 4/2017 Zeigler
9,714,523 B2 7/2017 Lilly, II
9,752,345 B1 9/2017 LaHood
9,869,110 B2 1/2018 Krenzel
10,060,151 B2 8/2018 Krenzel
10,309,093 B1 6/2019 Urhausen et al.
10,858,856 B1 12/2020 Dusek
10,995,516 B2 5/2021 Ribner
2004/0173252 A1 9/2004 Bouchard
2005/0189009 A1 9/2005 Walter
2005/0204680 A1 9/2005 Zeigler
2005/0204681 A1 9/2005 Zeigler
2006/0260666 A1 11/2006 Choi
2006/0272695 A1 * 12/2006 Mettavant ..... E04H 15/56 135/126
2006/0283103 A1 12/2006 Chen
2007/0039639 A1 2/2007 Duncan
2007/0051399 A1 3/2007 Jung
2007/0084493 A1 4/2007 Prusmack
2007/0125410 A1 6/2007 Williams
2008/0017232 A1 1/2008 Zeigler
2008/0017233 A1 1/2008 Zeigler
2008/0053508 A1 * 3/2008 Dewitz ..... E04H 15/425 135/124
2008/0264462 A1 10/2008 Rottmann
2010/0126545 A1 * 5/2010 Bullivant ..... E04H 15/36 135/125
2010/0170162 A1 7/2010 Pfeiffer
2012/0090455 A1 4/2012 Duncan
2012/0266929 A1 * 10/2012 Nelson ..... E04H 15/22 135/121
2013/0008478 A1 1/2013 Prieto Estebanez
2013/0104947 A1 * 5/2013 Hotes ..... E04H 15/34 135/96
2014/0060599 A1 * 3/2014 Hotes ..... E04H 15/10 29/592.1
2014/0182643 A1 7/2014 Yang
2015/0167343 A1 6/2015 Fang
2015/0240513 A1 8/2015 Fang
2017/0234029 A1 * 8/2017 Walter ..... E04H 15/30 135/147
2017/0234031 A1 * 8/2017 O'Sullivan ..... E04H 15/56 135/115
2017/0247906 A1 8/2017 Zeigler
2018/0155952 A1 6/2018 Robert
2020/0190844 A1 6/2020 Ribner

FOREIGN PATENT DOCUMENTS

DE 29517290 12/1995
DE 29716289 10/1997
FR 2997984 5/1914
FR 2614351 A1 * 10/1988
FR 2705718 12/1994
GB 2121850 A * 1/1984 ..... E04H 15/36

* cited by examiner

RAPID-DEPLOYMENT SHELTER

FIELD OF THE TECHNOLOGY

The present disclosure relates generally to shelters, shelter systems, hub systems for shelters, hub shelters, and more particularly to an improved shelter system, apparatus, kit and methods, for example, for deployable shelter assemblies.

BACKGROUND

Deployable shelters, tents, rapid-deployment shelters, forts and the like typically include sheets of fabric, or other materials, secured to a frame. Often these units are free-standing or are similarly semi-attached to a ground surface or tangential fixture. In some instances, guy ropes help anchor the unit to a ground surface once the shelter is assembled. Rapid deployment and assembly of such a shelter is often a difficult and demanding task, particularly during emergency situations and in uncertain environmental conditions.

For instance, rapid tactical shelters are used in a variety of demanding on-site scenarios including fire, incident command, communication areas, crime scene investigation, vaccination, military deployment, temporary hospital, and other on-site emergency response spots in a variety of challenging terrains, and environmental conditions. Rapid deployment, with quick and easy set-up and take-down of such units is often beneficial, if not necessary. Deployment situations may be, for example, in extreme heat or cold, during on-going emergencies and in remote locations, making ease of assembly extremely important and transportation of weighted items impractical. Durability of items in such terrain and environmental situations can also be a challenge. Incremental changes to weight, cost, ease of assembly and durability of deployable shelters and related shelter systems can result in large improvements in the field.

Therefore, Applicants desire improved systems, kits, assemblies, apparatus and methods for shelters and hub systems for deployment shelters and it is toward these and other challenges the present disclosure is directed.

SUMMARY

In accordance with the present disclosure, hub systems for assembly of a shelter frame, and improved shelter systems and assemblies are provided for deployment shelters, shelter hubs, and shelter assemblies and the like. This disclosure provides an improved shelter and shelter hub system that is convenient, efficient, easily portable, reliable, durable, and quick for the user, particularly when used in conjunction with other shelter accessories often used in deployment shelters, for example HVAC, lighting, power cords, interior insulation, etc.

In one embodiment of the present disclosure, a hub for assembly of a shelter may include at least one receiver slot, a receiver sleeve, and at least one attachment point.

Other embodiments may be considered a hub for assembly of a rapid-deployment shelter. The hub may include, in some examples, a set of receiver slots, a receiver sleeve and a set of attachment projections. The receiver slot may include two parallel slot walls, a slot floor and a center slot wall. The receiver sleeve may be medially positioned to the receiver slots. The set of attachment projections may be rounded or may take on other shapes. The set of attachment projections may be attached at each end to a slot wall.

In some embodiments, a receiver sleeve may include an inner receiver and an outer receiver. The inner receiver and outer receiver may form a pressure lock system. The inner receiver and outer receiver walls may be angled. The angle may, for example, be between about 0.001 and 1 degrees, or is contemplated to also be more. In some examples, the taper may be at 0.5 degrees. The inner receiver may be angled inwardly from the floor. The outer receiver may be angled outwardly from the floor. In some examples, the taper of the angle of the outer receiver may be opposite that of the taper of the angle of the inner receiver.

Some examples of frame and hub assemblies include a set of hubs and a set of frame poles. In some examples, the frame and hub assembly may include variations of the hub, for example, partial hubs, by way of example, for corners of the frame assembly. Embodiments may include methods for assembly of the frame and hub assembly in which the frame poles are connected through the hubs. In some examples, a hub may be placed and oriented top down, bottom down and/or on a hub side to form the frame and hub assembly. There may be a portion of the hubs horizontally oriented in connecting the hubs and a portion of the hubs vertically oriented in the frame and hub assembly. There may be partial hubs included in the frame and hub assembly. Partial hubs may be specialized to accept frame poles in hard to fit positions, for example, in frame and hub assembly corners and/or long frame pole articulations.

In still other examples, the inventions of the present disclosure may be considered a frame for an emergency, rapid-deployment shelter system. The frame may include a set of hubs and a set of frame poles, a portion of the frame poles secured with a portion of the hubs to form a skeleton frame for a rapid-deployment shelter system. The rapid-deployment shelter system may include more than one shelter.

The rapid-deployment shelter system may include more than one shelter mated with other rapid-deployment shelters. A shelter hub may interconnect more than one rapid-deployment shelter.

Other embodiments may be considered a shelter system including a frame, a cover and at least one hub. The frame may include a plurality of interconnected frame poles. The frame poles may be configured to alternate between a first extended position and a second retracted position. The cover may be configured to mate with the frame and/or be secured to the frame. The hub may include a set of receiver slots, a receiver sleeve, and a set of attachment projections.

Some embodiments may include a frame, a shelter, a shelter cover, and shelter accessories.

In other examples the inventions disclosed may be considered hub and shelter methods, for example a method for a hub, a method for a shelter system kit, a method for an improved shelter and a method for rapid deployment of a shelter according to the disclosure.

The above summary was intended to summarize certain embodiments of the present disclosure. Embodiments will be set forth in more detail in the figures and description of embodiments below. It will be apparent, however, that the description of embodiments is not intended to limit the inventions of the present disclosure, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
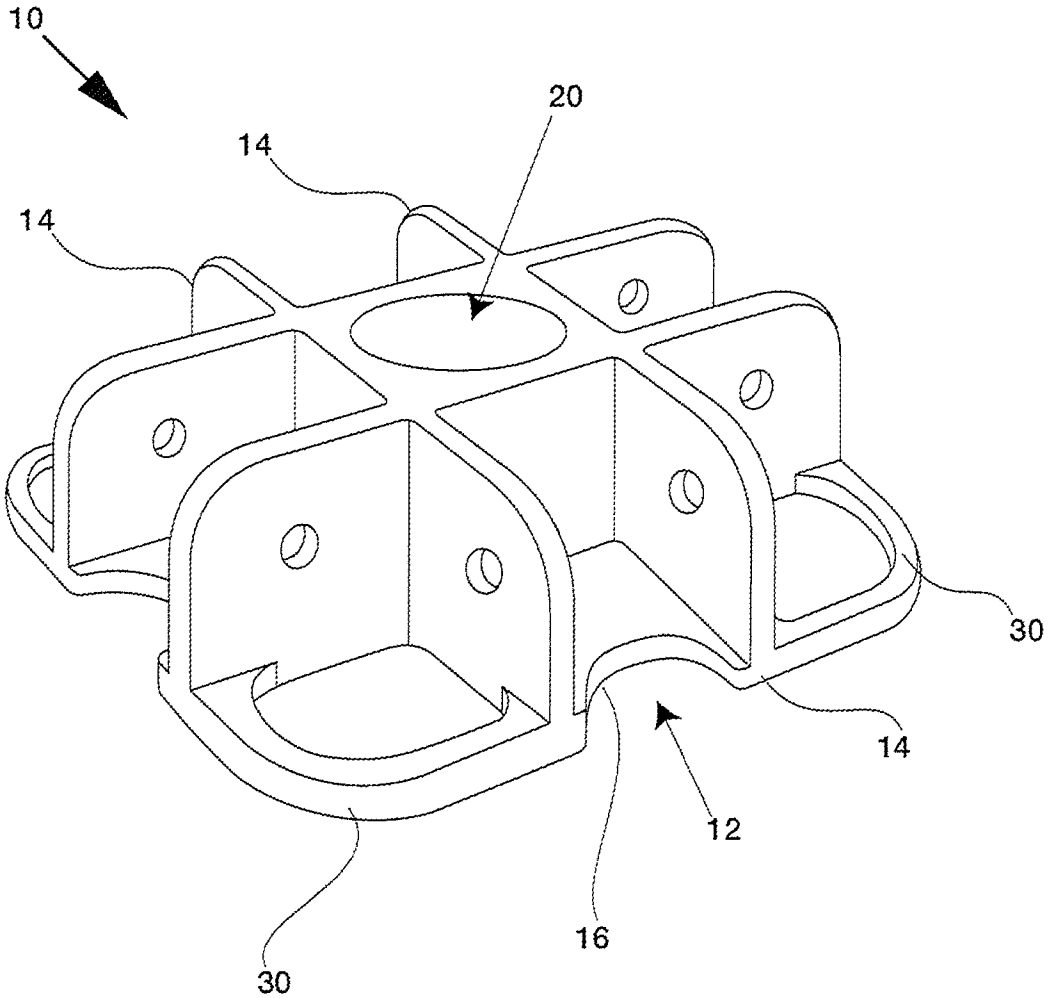
FIG. 1 is a side perspective view of one example of a hub for a deployment shelter according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general, it will be understood that the illustrations are for the purpose of describing embodiments of the disclosure and are not intended to limit the disclosure or any invention thereto. Collapsible shelters generally have a short lifespan as they expand and then collapse into a carryable form repetitively, and generally are thrown about experiencing a significant amount of wear and tear. These types of shelters are often thought of as readily replaceable and priced accordingly. Rapid deployment shelters, however, are much more significant purchases and are used under extreme conditions in emergency deployments, precarious weather situations, in remote locations and are expected to function seamlessly, with higher expectations in repetitive deployments. Applicant realizes that durability, ease of use, strength and weight associated with rapid deployment shelters are extreme challenges and can all be limiting factors. It is to these and other challenges that Applicant's improved hub and shelter system is directed.

FIG. 1 shows a side view of one example of a hub 10 for a shelter according to an embodiment of the disclosure. A hub 10 for assembly of a shelter may include at least one receiver slot 12, a receiver sleeve 20, and at least one attachment projection 30. In some examples, at least a portion of the hub 10 is made of glass filled nylon and in other examples; the hub 10 may be entirely made of glass filled nylon. Applicant realized that formulating the hub 10 out of glass filled nylon, for example instead of the traditional metal, could give the hub slightly more flexibility than a metal hub, however, strength and durability were concerns. Applicant's hub 10 may exclude metal parts.

Figure 2:
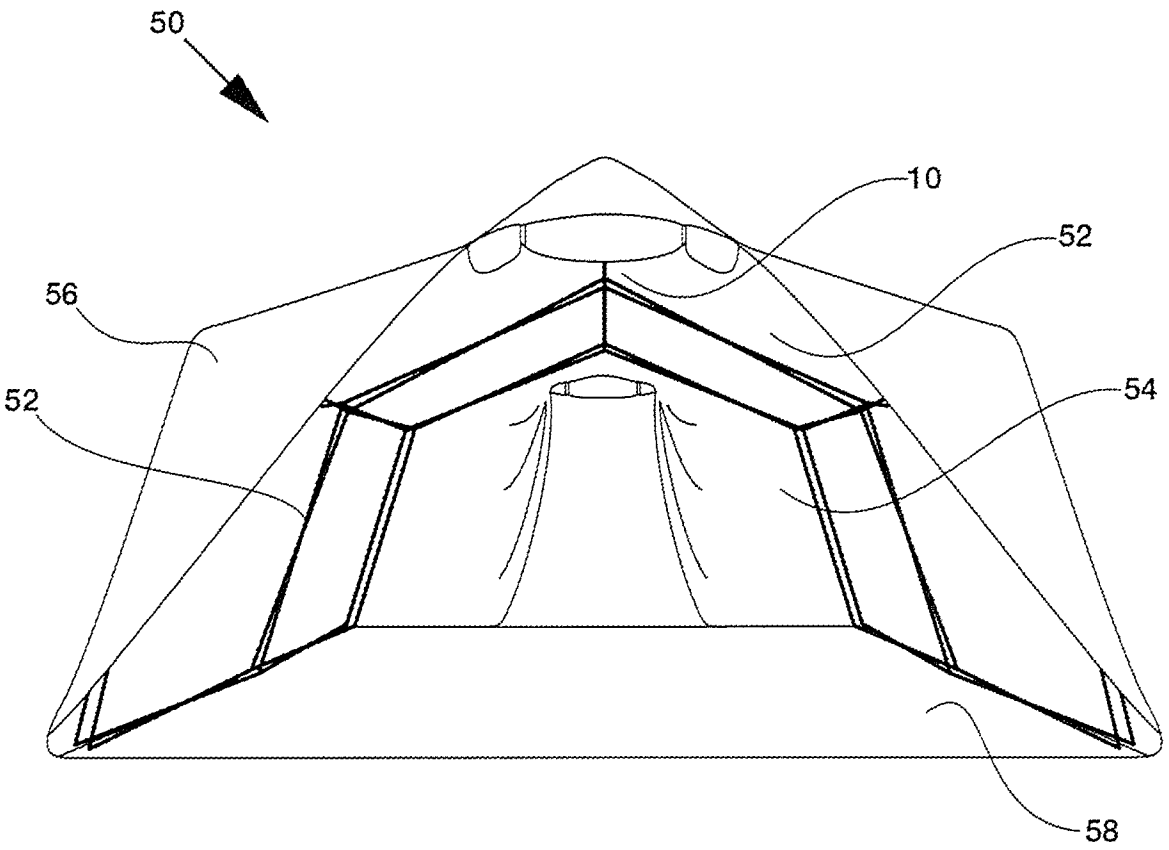
FIG. 2 is a front view of a one example of a deployment shelter with a hub system according to an embodiment of the disclosure.
Figure 3:
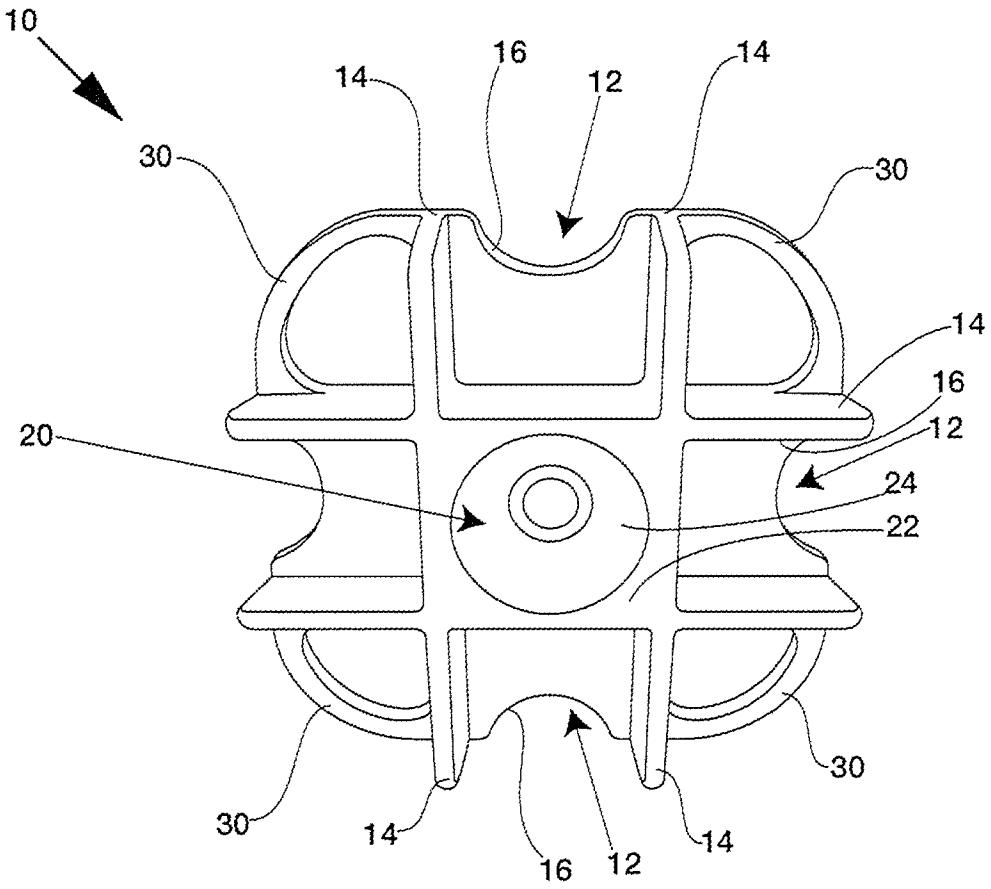
FIG. 3 is a top view of one example of a hub according to the present disclosure.
Figure 4:
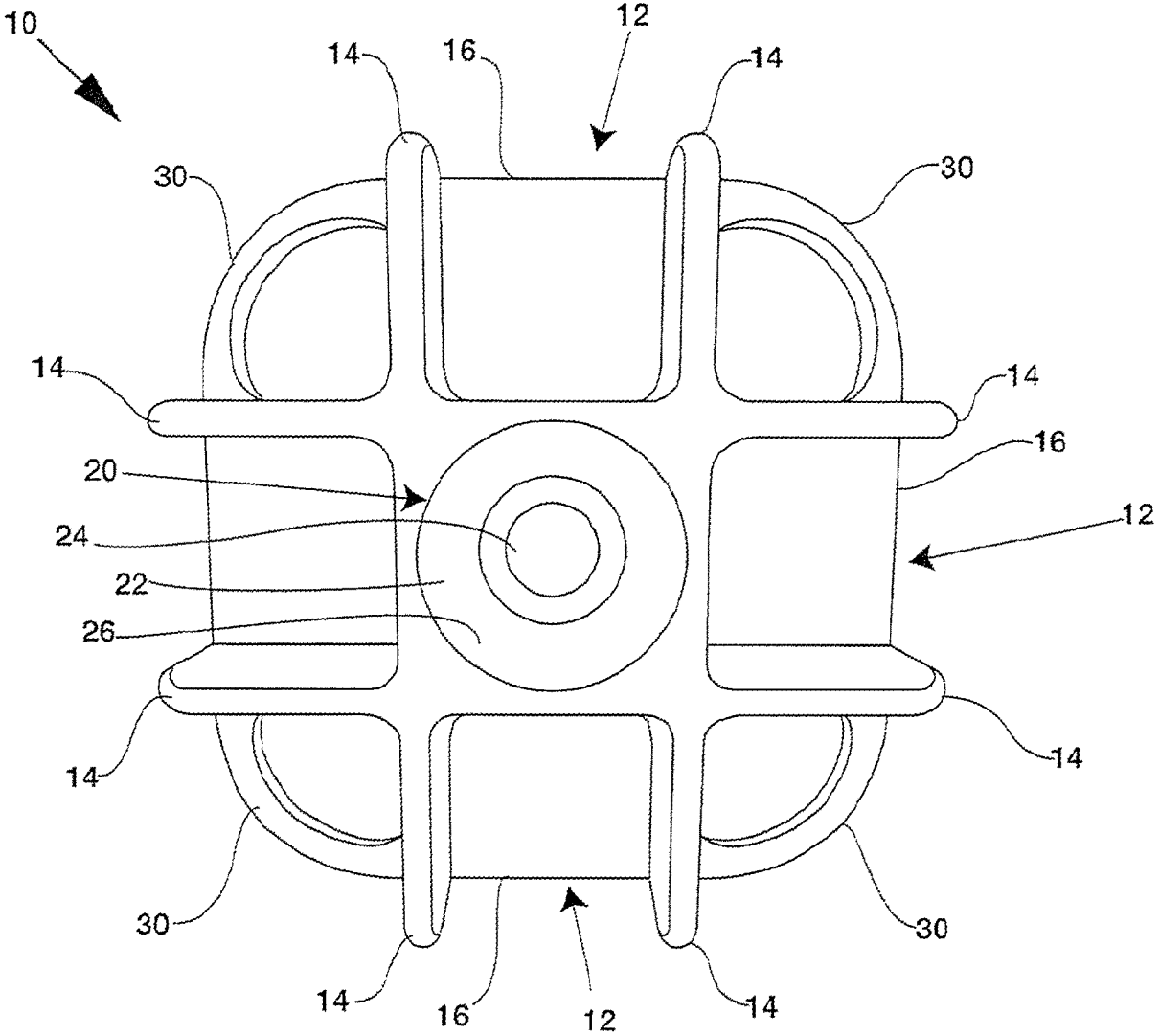
FIG. 4 is a top view of one example of a hub according to the embodiment of FIG. 1.
Figure 5:
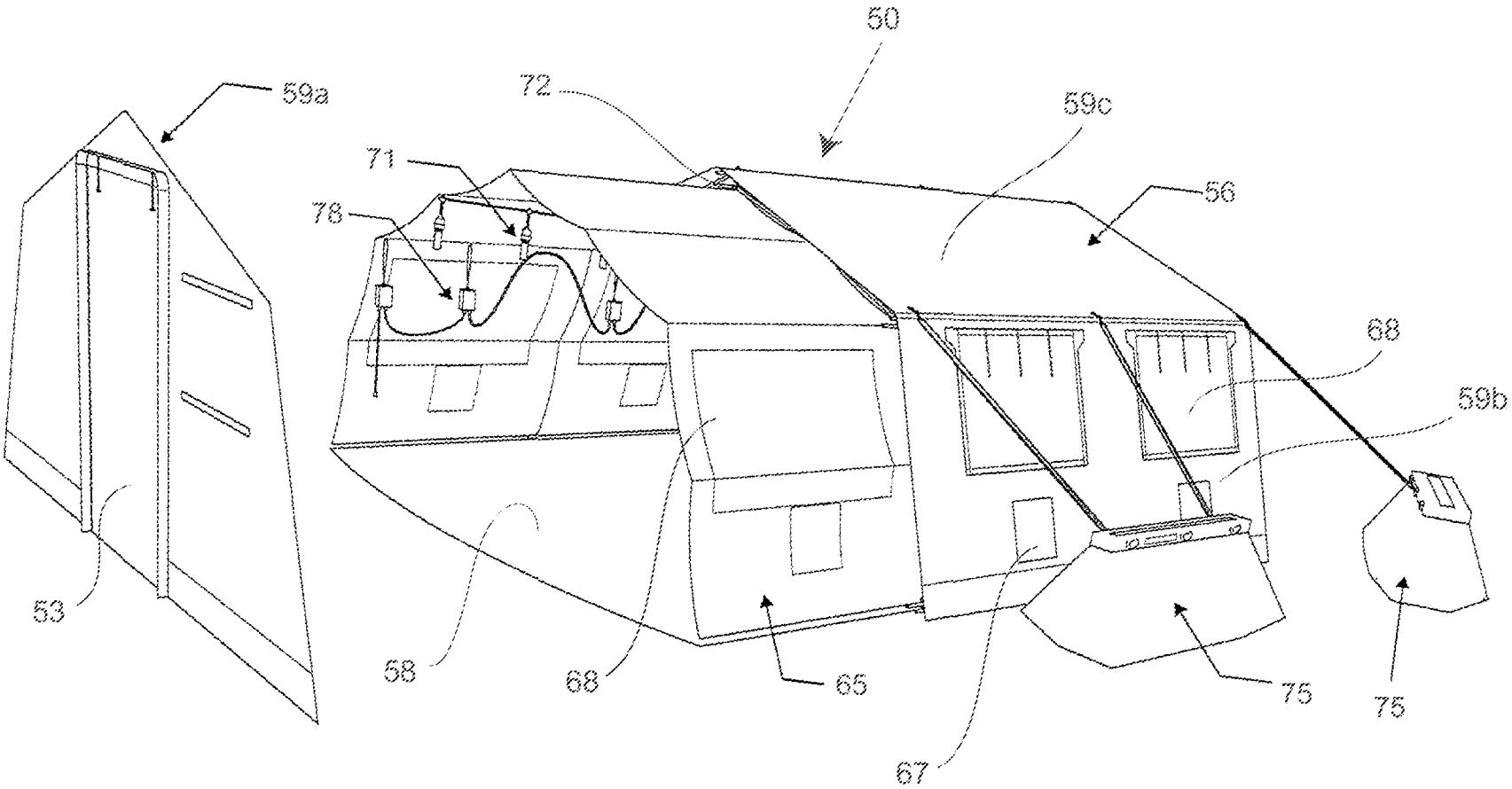
FIG. 5 is an exploded view of one example of a shelter according to the present disclosure.
Figure 6:
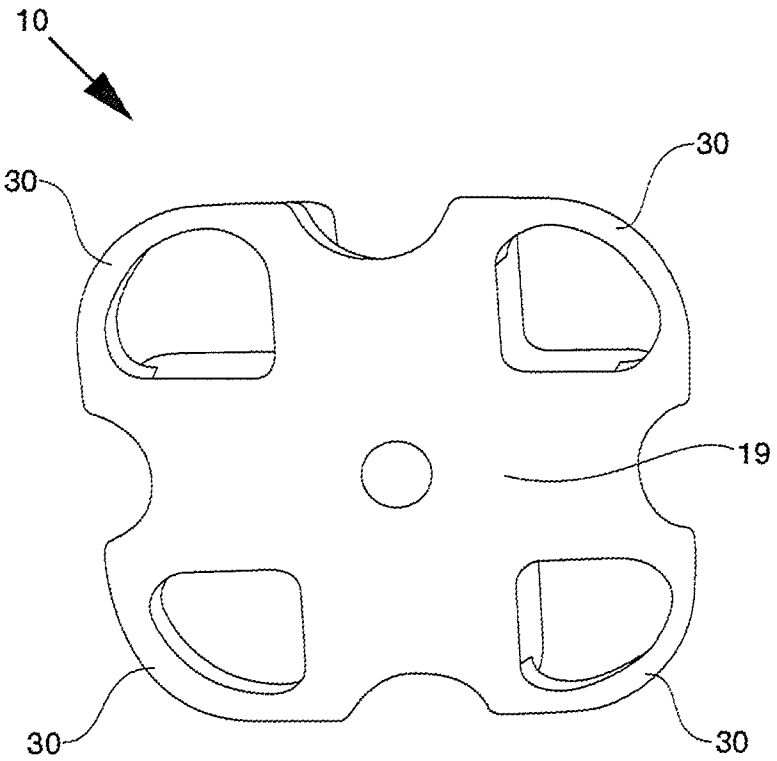
FIG. 6 is another example of a bottom view of a hub according to the present disclosure.

One or more hubs 10 may make up a hub system for a deployment shelter 50, as seen in FIGS. 2 and 5. An articulating frame system of frame poles 52 may mate with, provide a skeleton frame for, a shelter cover 56. Shelter covers 56 are often made of a fabric or canvas material that may be torn or ripped during contact with traditional frames, especially those with metal parts and assemblies. Applicant's hub reduces the chances of wear and tear on both the frame and the cover of the shelter. In many cases, when a shelter is expanded, a cover 56 is required to be secured to the frame by way of an attachment strap with an attachment buckle that expands between the cover and the hub. The need for such attachment straps has been eliminated with Applicant's improved hub, in one example, by the hub pressure lock structure, described in more detail later. In some examples, however, attachment straps and/or buckles may be desired and are considered with the scope of the inventions of the disclosure.

Any of the shelters 50 shown or described herein may include a variety of field deployment elements. For instance, the shelter 50 may be light weight for easy carry and transport and may include an articulated frame 72, a robust cover/canopy 56 and covering/canopy features. By way of example, a shelter 50 and/or shelter cover 56 may include, flooring 58, floor liner, end wall 59 and door ends 53, lighting features, power features, electrical supply 78, lighting 71, liners 65, bedding, bunk bedding, tables, shelter identification tags, emergency response equipment, and additional water features and water bladders, an anchor 75 serving as a weight, and/or sand bags. Shelters 50 may include windows 68.

The shelters may be any size and multiple shelters may be joined through door ends 53 and/or end walls 59 to create scalable complexes with the advantages of the inventions herein. Joined shelters may be considered shelter systems 170 including more than one shelter joined at a matched face 100 and include any of the embodiments and features included in the present disclosure. Some shelters 50 may serve as a shelter hub 150 and include scalability of connectivity between two or more shelters.

Particular shelter examples include, but are not limited thereto, a unit with floor space of about fifteen feet by twelve feet and an area of about one hundred and height square feet;

a unit with floor space of fifteen feet by eighteen feet and an area of about two hundred and seventy feet; and a variety of other sizes.

In other embodiments, the disclosure includes a shelter kit. In this embodiment, the kit may comprise at least one shelter 50, e.g., any of the shelters and/or shelter accessories shown or described, and a plurality of hubs 10, e.g., any of the hub embodiments shown or described.

Other embodiments, seen throughout FIGS. 3-8, may be considered a hub 10 for assembly of a rapid-deployment shelter 50. The hub may include, in some examples, a set of receiver slots 12, a receiver sleeve 20 and a set of attachment projections 30. The receiver slot 12 may include slot walls 14, a slot floor 16 and a center slot wall. The receiver sleeve 20 may be medially positioned to the receiver slots 12. The set of attachment projections 30 may be rounded or may take on other shapes. The set of attachment projections 30 may be attached at each end to a slot wall 14. In some examples, an attachment area 29 may be formed between two slots. The attachment area 29 may have one side forming a substantially right angle, formed by the intersection of two receiver slot walls. Opposite the attachment area side having a substantially right angle, the area 29 may include a rounded surface. An attachment projection 30 may be cornered between two receiver slots 12.

The receiver slot 12 may include a first slot wall 14 and a second slot wall 14, positioned such that the two slot walls are substantially parallel, and each attached to a slot center wall and a slot floor 16. In some examples, a slot wall 14 of one receiver slot 12 is substantially perpendicular to the slot wall 14 of an adjacent receiver slot 14.

In some embodiments, receiver sleeve 20 may include an inner receiver 24 and an outer receiver 22 and a sleeve bottom 26. The inner receiver 24 and outer receiver 22 may form a pressure lock system. The inner receiver 24 and outer receiver 22 walls may be angled. The angle may, for example, be between about 0.001 and 1 degrees, or is contemplated to also be more. The inner receiver 24 may be angled inwardly from the floor. The outer receiver 22 may be angled outwardly from the floor. The inner receiver 24 and outer receiver 22 walls may be angled away from each other at the top of the receiver 20 and toward each other toward the floor of receiver 20. The angled inner receiver 24 wall and the angled outer receiver wall 22 may form a pressure lock system for accepting a frame pole 52, for example and specifically a spacer pole 51, and securing the pole with the hub 10.

Attachment projections 30 may be attached on one end to a slot wall 14 that is perpendicular to the slot wall 14 attached to the other attachment projection end. Attachment projections may be curved, rounded or take on any other applicable shape. Many shelter accessories 60 (see FIG. 9) are utilized with rapid deployment shelters, as previously discussed, and these items often need to be attached or secured with the shelter. Such items as HVAC components and insulation sheets can be heavy and place a large weight load on the shelter, especially the shelter frame, and there is traditionally not a good place to attach such items. Applicant's hub system includes attachment projections 30 and a pin system 80 that collectively simplify assembly of the shelter and also provide unique attachment options for accessory items and attachments, without compromising the frame and shelter integrity and without increasing shelter carry weight. Attachment projections 30 secure attachment objects to the frame securely so that the attachment objections do not move along the frame. In some examples, the rounded outer side of projections 30 presents a curved surface for contact with the shelter canopy and other accessory items, preventing wear and tearing that may occur with a non-rounded surface.

The attachment projections 30 are configured to allow shelter accessory 60 attachment with accessory attachments 60.

The hub weight, in some examples, may be less than or equal to about 1.75 oz. The hub weight in other examples may be between about 1.25 oz. to about 1.75 oz. The hub may be at least about 4 mm thick. The hub may be at least about 5 mm thick in other examples. Applicant was able to realize a reduced hub weight of over 40% of that of conventional hubs, while increasing the strength and durability of the hub 10.

In some embodiments, attachment projections 30 may be about 0.20 to about 0.260 inches in thickness. The attachment projections 30 may be at least 0.250 inches in thickness. The hub base, flooring between the slot walls 14, may be substantially between 0.150 inches to about 0.200 inches in thickness. The hub base may be at least 0.200 inches in thickness in some examples.

Applicant conducted vertical break testing for the hub to simulate the weight that is often supported from a hanging position on attachment points for rapid deployment shelters by accessory and attachment items. Weight was applied to the hub in increments and increased until vertical break was detected. Applicant desired attachment points with low weight, ease of access, durability and strength. In some examples, hub 10 and the attachment projections 30 may have an average vertical break of above 125 lbs., 145 lbs. or 155 lbs. In some examples, the vertical break may be between about 145 lbs. and about 170 lbs.

Applicant conducted lateral break testing to simulate the side pull that is to be withstood from a side load position. Again, Applicant desired attachment points with low weight, ease of access, durability and strength. Weight was again applied to the hub in increments until vertical break was detected. In some examples, the hub 10 and attachment projections 30 may have an average lateral break of above 150 lbs., 160 lbs., or 170 lbs. In some examples, the lateral break may be between 150 lbs. and about 200 lbs.

Other embodiments may be considered a shelter system 70 including a frame 72, a cover/canopy 56 and at least one hub 10. The frame 72 may include a plurality of interconnected frame poles 52. The frame may include a connector 57. The connector 57 may span between the front right and front left corners of the frame. The connector 57 may also span between the back left and back right corners of the frame. The connectors may be frame poles 52, straps, elastic, nylon or any other suitable material. The connectors may stabilize the frame. The connectors may be a set of connectors joined end to end. The connectors may be frame base connectors. The frame poles 52 may be configured to alternate between a first extended position and a second retracted position. The retracted positon may include just the frame poles 52 in a retracted position, the frame poles 52 and the hubs 10 in a retracted position, and/or the frame poles 52, hubs 10 and the canopy 56 in a retracted position, assembled and/or unassembled for storage and transport. The entire shelter system may fully retract in a second position and fully expand without assembly into a first deployed position. The cover 56 may be configured to mate with the frame 72 and/or be secured to the frame or may be already mated with the frame. The hub 10 may include a set of receiver slots 12, a receiver sleeve 20, and a set of attachment projections 30.

In one embodiment, a shelter 50 may include a frame 72 and a cover 56. The cover may include at least two end walls

59*a* joined with at least two side walls 59*b* and a roof 59*c*. The end walls 59*a* may be removable and/or retractable. End walls 59*a* may be attached to the side walls 59*b*, for example, by Velcro, zipper, hooks, buttons, ties, a combination of these, and/or any securing means. The end wall 59*a* may include a door end 53. Door end 53 may be removable and/or may be retractable. The roof 59*c* may mate with the side walls 59*b*. The roof may include a peak in the roofline that runs along the length of the cover and angles downwardly on each side of the peak toward an interface of the roof and each side wall. A side wall 59*b* may include one or more window 68. An end wall may include one or more window 68. A side wall 59*b* may include an access panel 67. Side wall 59*b* may include one or more access panel 67. Access panel 67 may be, in one example, an HVAC access panel adapted to incorporate an HVAC system into the shelter 50.

Figure 9:
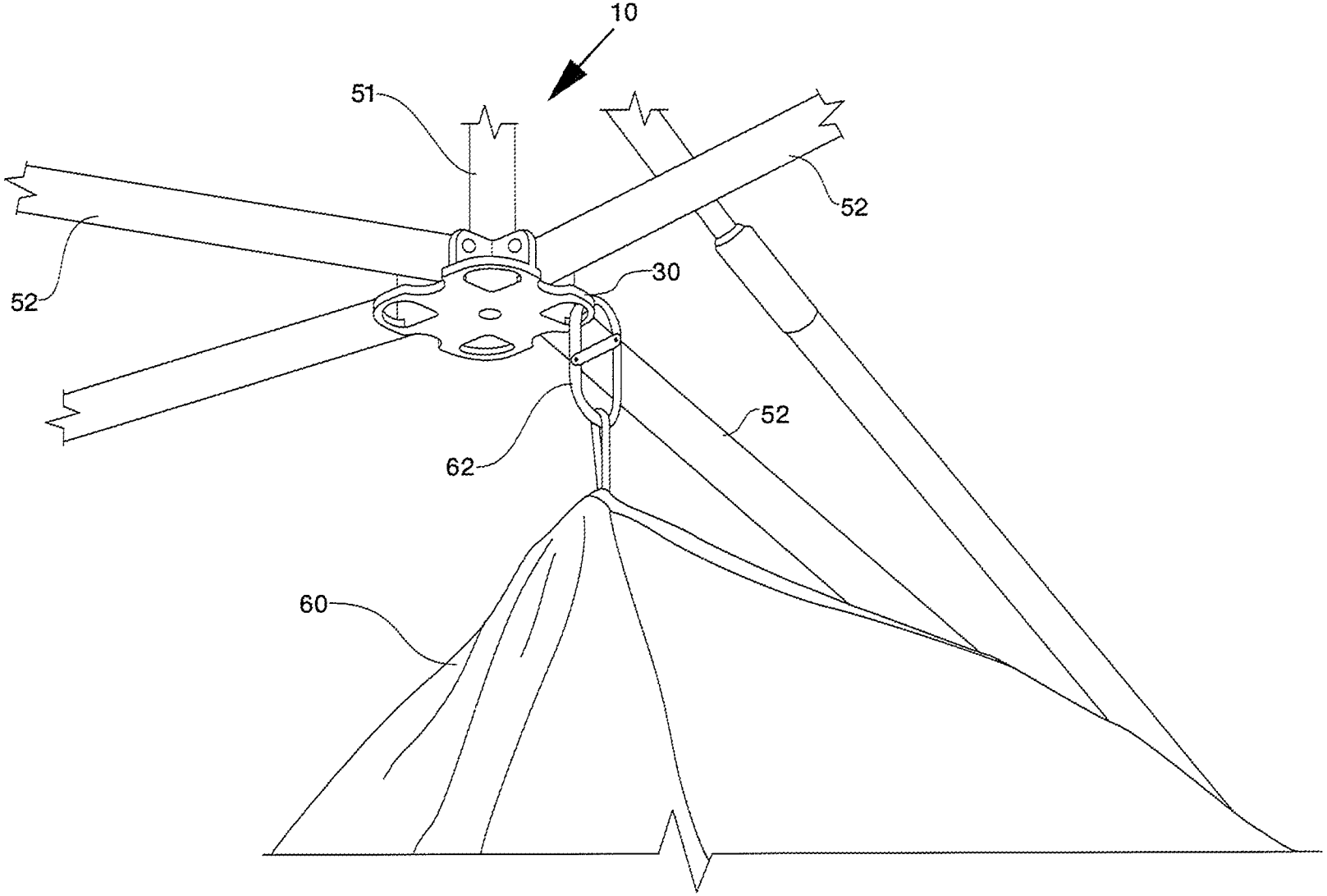
FIG. 9 is a perspective view of another example of a portion of a hub assembly of a hub system, according to the present disclosure.
Figure 10:
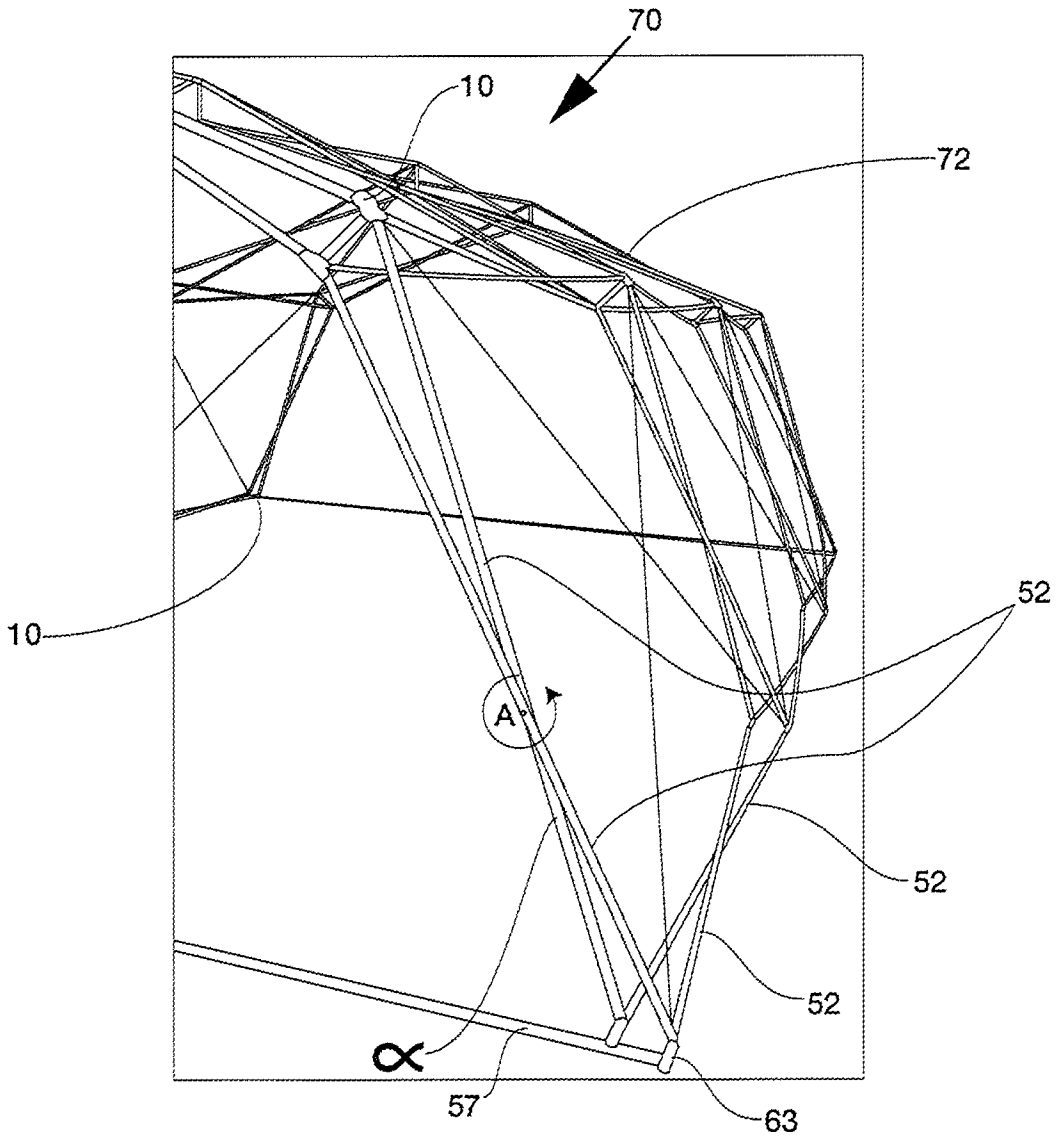
FIG. 10 is a perspective view of one example of a frame and hub assembly of the rapid-deployment frame and shelter system, according to FIG. 2.

The shelter 50 may include an insulation liner 65. The insulation liner may include windows 68. The windows 68 of the insulation liner may align with the shelter windows in the cover 56. Insulation liner 65 may include an access panel 67. The access panel 67 in the insulation liner 65 may align with an access panel 67 in the side wall 59*b*. The insulation liner 65 may be aligned with and attached to the frame 72. The frame 72 may support insulation liner 65. As seen in FIG. 9, insulation liner may attach to frame 72 and hang supported by way of frame 72. In some examples, the insulation liner 65 may attach to a hub 10 in the frame 72 by way of attachment to an attachment projection 30.

The shelter system 50 may include lighting 71 for the shelter. The shelter system 50 may include an electrical supply 78 for the shelter.

Figure 7:
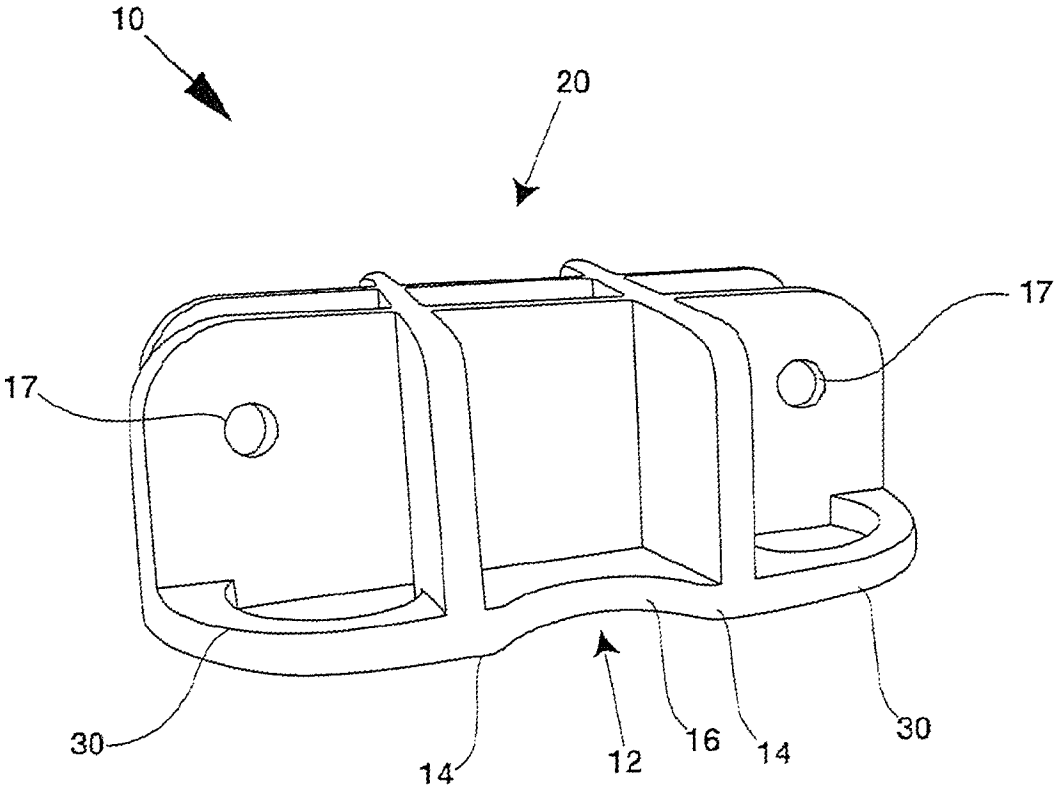
FIG. 7 is a side perspective view of one example of a hub according to the embodiment of FIG. 1.
Figure 8:
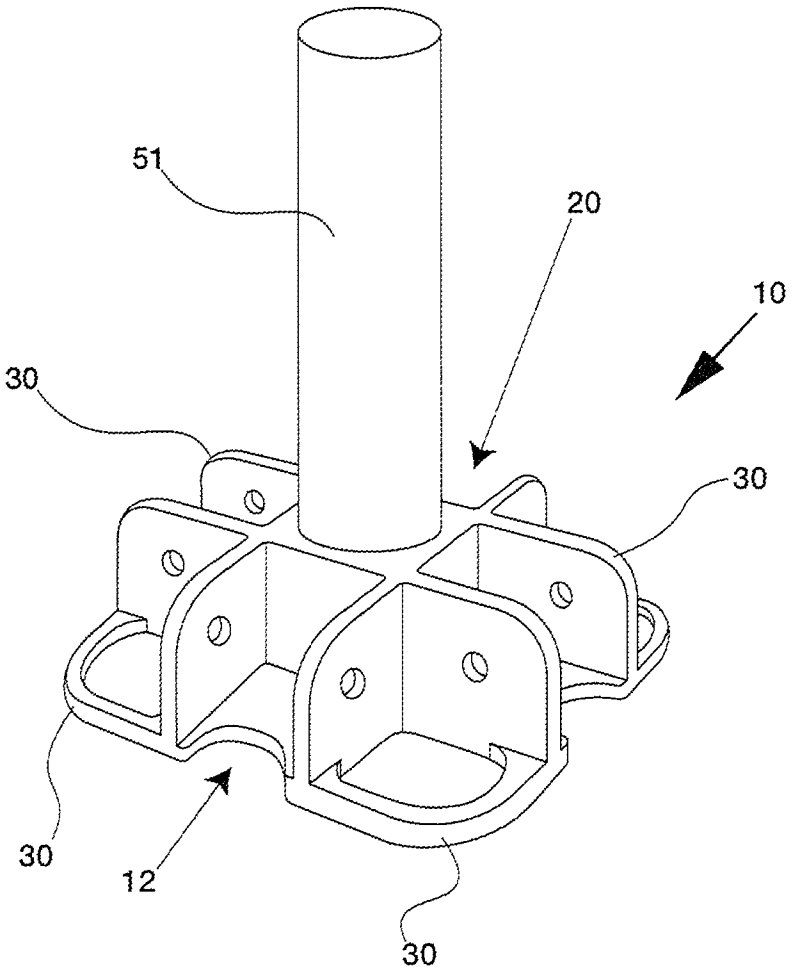
FIG. 8 is a side perspective view of one example of a portion of a hub assembly of a hub system according to the present disclosure.

In some embodiments the pin system 80 may include a plurality of pins and matched washers. Applicant's pin system, as seen in FIGS. 5 and 7, may fit through slot openings 17 on slot receiver walls 14 to secure in place attachments and/or frame poles 52. Once a frame pole 52 is mated with a hub 10, the pole 52 may be secured movably to the hub 10 with a pin system 80 with a washer 89 and pin 86. Applicant's articulating frame poles 52 and configuration may include openings that accommodate and match with the openings 17 and the pin system 80. By way of example, the pin 86 and washer 89 may be made of glass filled nylon able to remain durable and also light weight and easy to repeatedly remove and replace into position. In this example, the pin 86 is configured to slide through the hub and tubes of the frame and to mate with its mated washer that is configured to pop over the end of the pin to lock tight. Conventionally, metal pins with split rings have been utilized with shelters, with the split rings being difficult to remove and assemble quickly and extremely difficult to replace in the field. Applicant's pin system increases ease of assembly and removal, maintains strength and decreases weight load. Applicant's pin system is economical, durable and reduces the time for assembly and/or repair of the shelter system.

FIGS. 10-14 show examples of a shelter system, one example including frame and hub assemblies, 70. A frame and hub assembly may include a set of hubs 10 and a set of frame poles 72. In some examples, the frame and hub assembly may include variations of the hub, for example, partial hubs 63, by way of example, for corners of the frame assembly. Embodiments may include methods for assembly of the frame and hub assembly in which the frame poles are connected through the hubs. In some examples, a hub may be placed and oriented top down, bottom down and/or on a hub side (seen in FIG. 12) to form the frame and hub assembly. There may be a portion of the hubs horizontally oriented in connecting the frame poles and a portion of the hubs vertically oriented in the frame and hub assembly. There may be partial hubs included in the frame and hub assembly. Partial hubs 63 may be specialized to accept frame poles in particular hard to fit positions, for example, in frame and hub assembly corners and/or long frame pole articulations.

In still other examples, the inventions of the present disclosure may be considered a shelter and frame for an emergency, rapid-deployment shelter system. The frame may include a set of hubs 10 and a set of frame poles 52, at least a portion of the frame poles secured with a portion of the hubs to form a skeleton frame for a rapid-deployment shelter system. The shelter and frame for an emergency, rapid-deployment shelter system fully assembled and movable between a first deployed position and a second retractable position. In the retracted position, the canopy, 56, frame poles 72 and hubs 10 may stay substantially attached with the frame poles 72 collapsing parallel and next to each other. The frame poles 72 may be internal poles, external poles and ceiling poles. Frame poles 72 may, for example, be in pairs 77. The poles in pairs may be connected at about a center point and the poles may retract to be parallel in the same plane. The poles in pairs may be connected at about a center point and the poles may rotate about an axis A (FIG. 10, 13) at the connected point to diverge at their ends away from each other. The connected poles may diverge at an angle alpha. The angle alpha may be about 1 to less than 90 degrees. The angle alpha may, by way of example, be about 5 to about 25 degrees.

Figure 11:
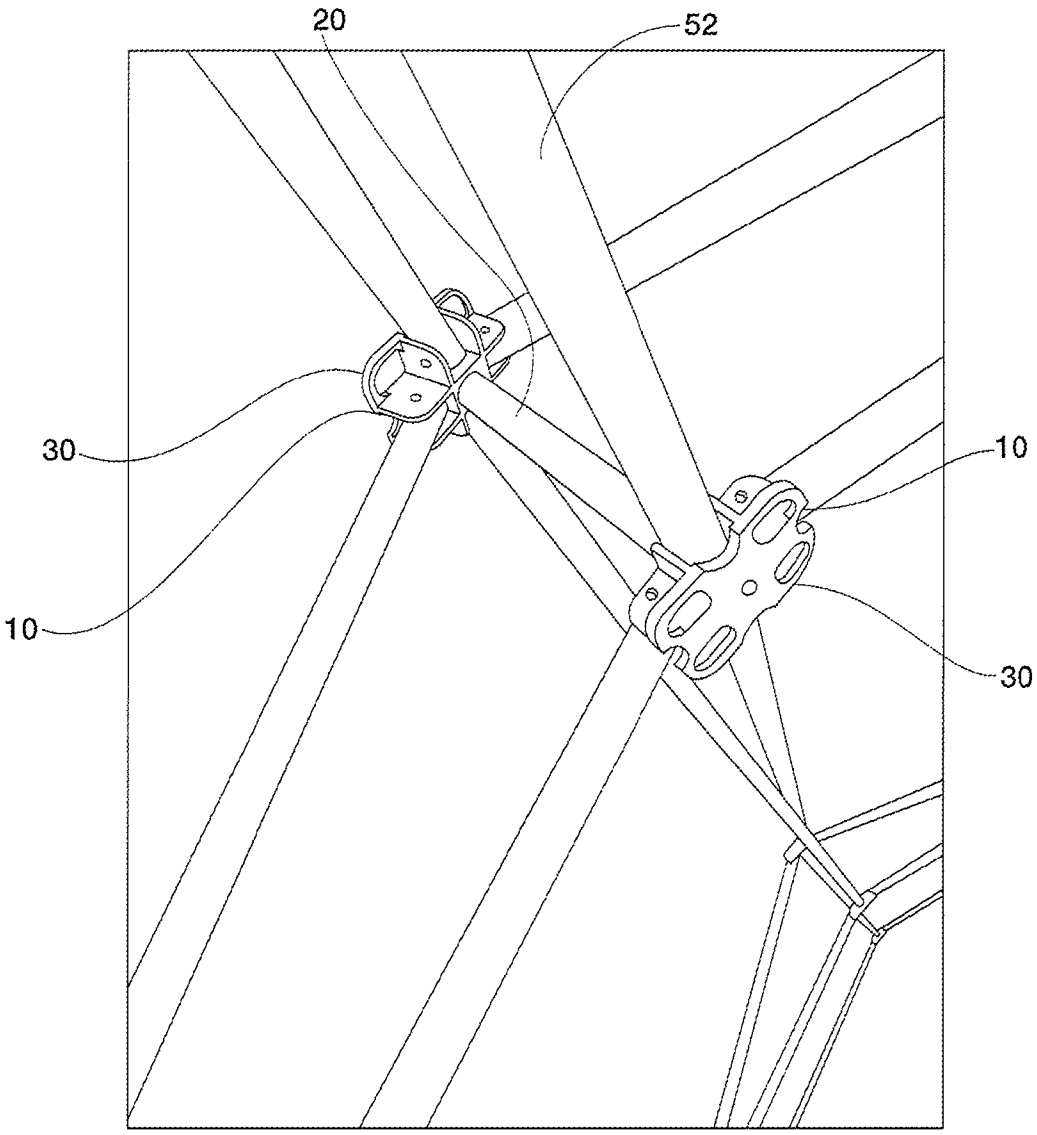
FIG. 11 is a close-up view of one example of the frame and hub assembly according to FIG. 10.

As seen in FIG. 11, the frame poles 52 may link with the hubs 10 to form frame 72. Attachment projections 30 are configured to accept attachment items.

Figure 12:
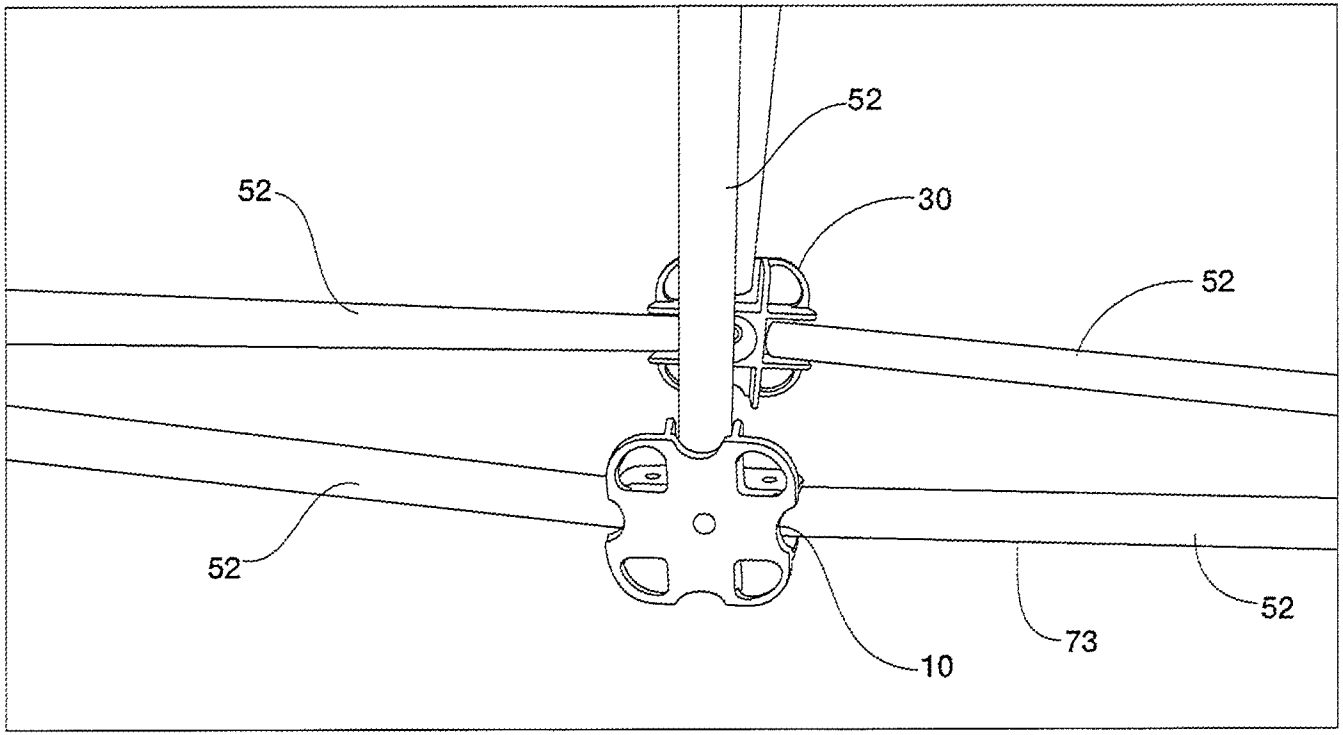
FIG. 12 is a close-up view of one example of a lower portion of the frame and hub assembly according to FIG. 10.
Figure 13:
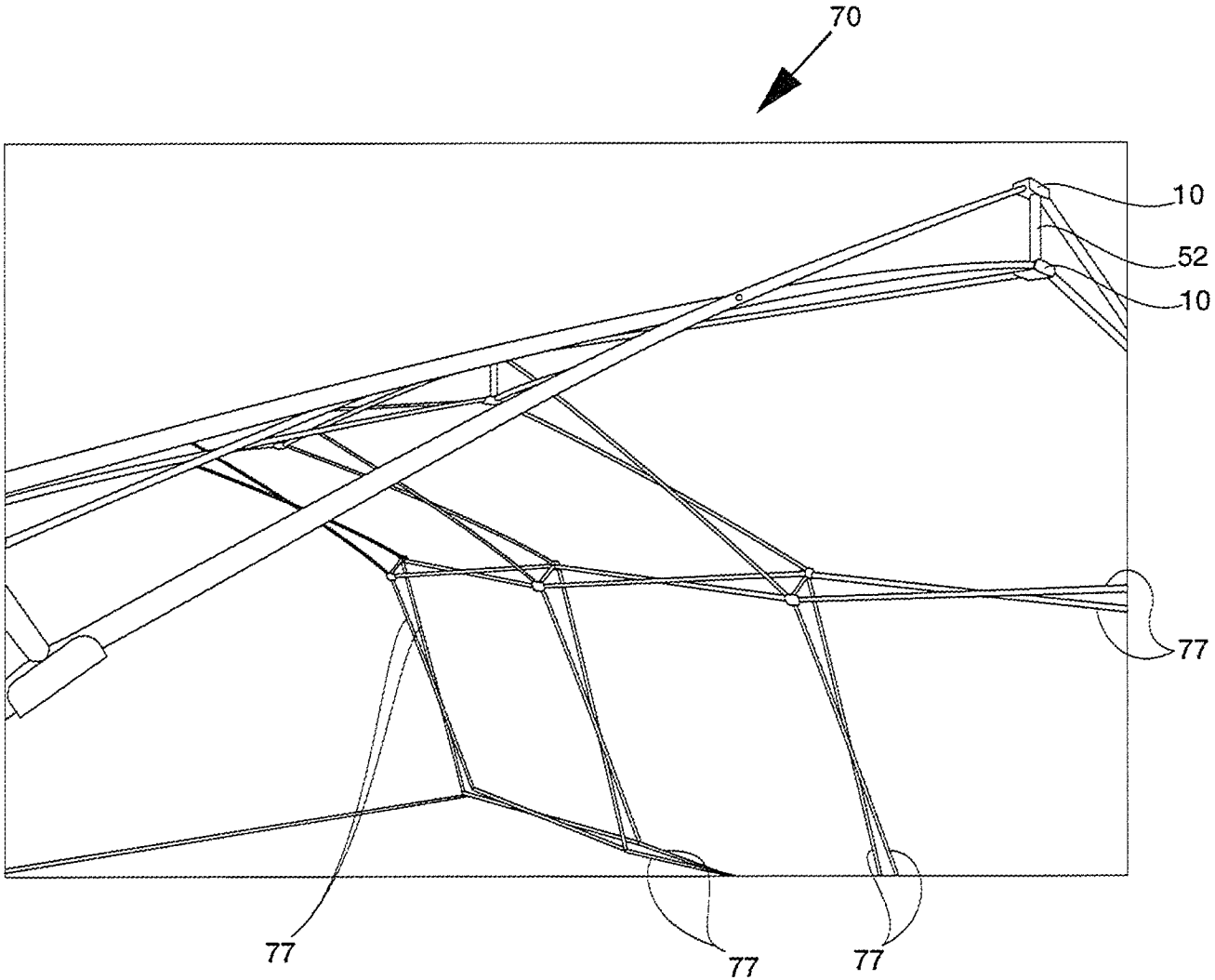
FIG. 13 is another opposite side perspective view of one example of the frame and hub assembly according to FIG. 10.
Figure 14:
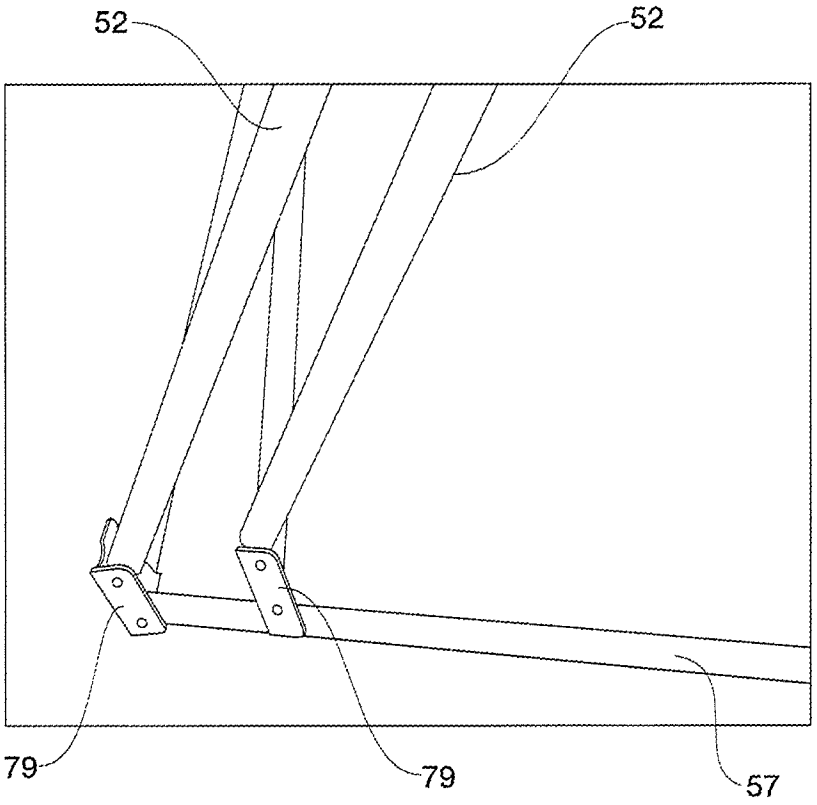
FIG. 14 is a close-up view of one example of a corner frame and hub assembly showing an example of a partial hub according to FIG. 10.

FIG. 12 shows a vertically aligned hub 10. Vertically aligned hubs 10 within the frame 72 may, as shown in FIG. 12, configure a space into the frame system and act as a spacer between two surfaces. The lower frame poles 52 in this example connect with a receiver slot 12 on a hub, thus the hub acting as a spacer to maintain a space between at least a portion of the lower frame poles 52 and the ground. In this instance, the space 73 is beneficial and allows portions of the canopy to wrap under the frame 70, and in some examples, without supporting weight.

Figure 15A:
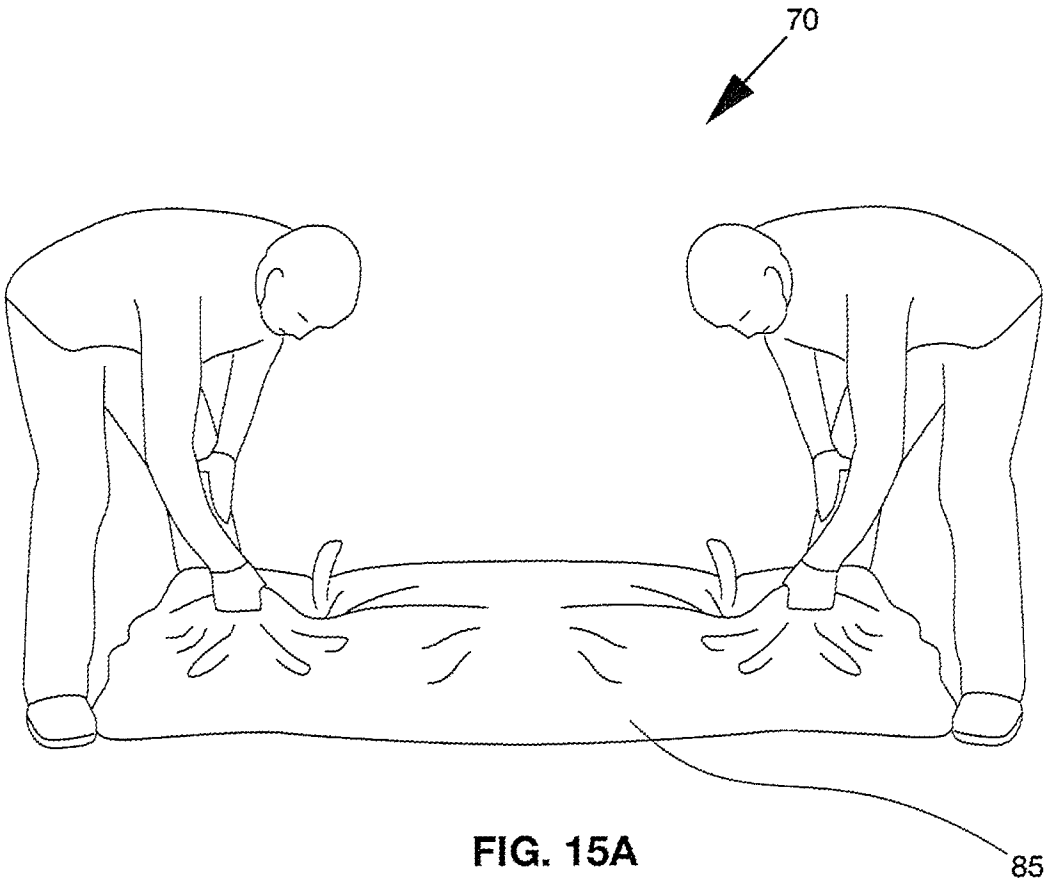
FIG. 15 A-G is perspective views of another example of a shelter frame and shelter hub assembly in a first deployed position and a second retracted position, according to the present disclosure.
Figure 15B:
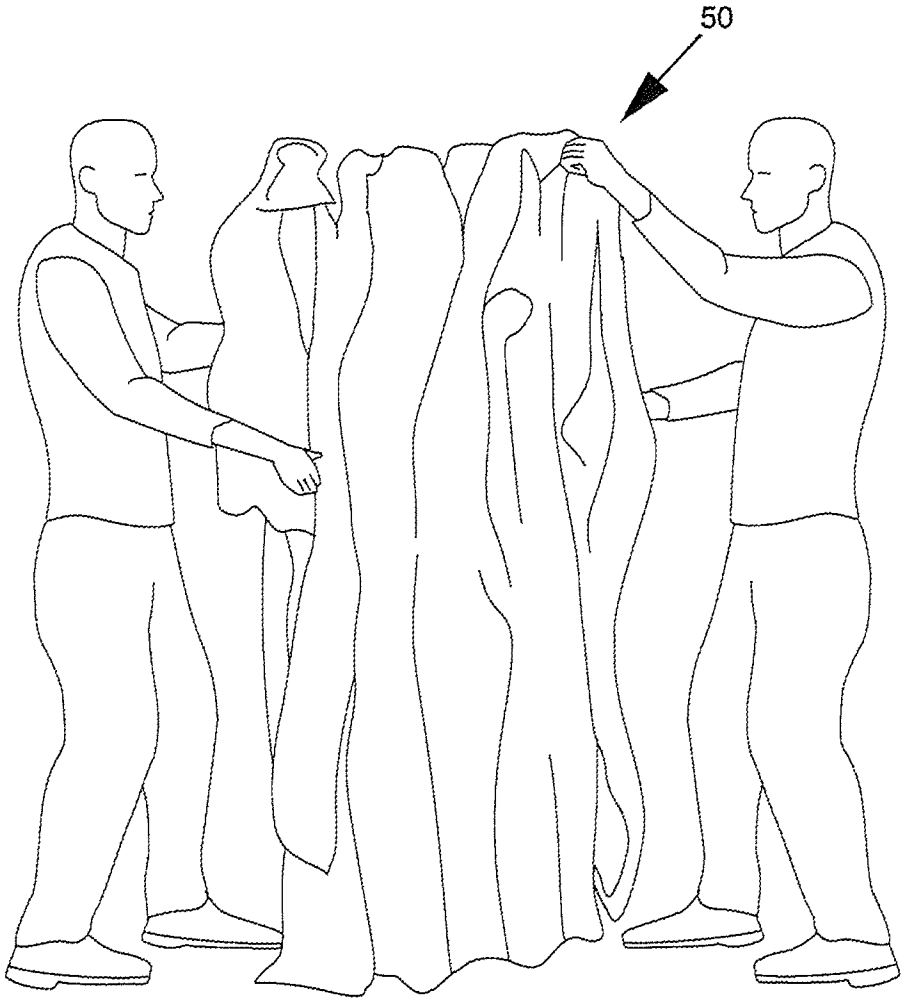
Figure 15C:
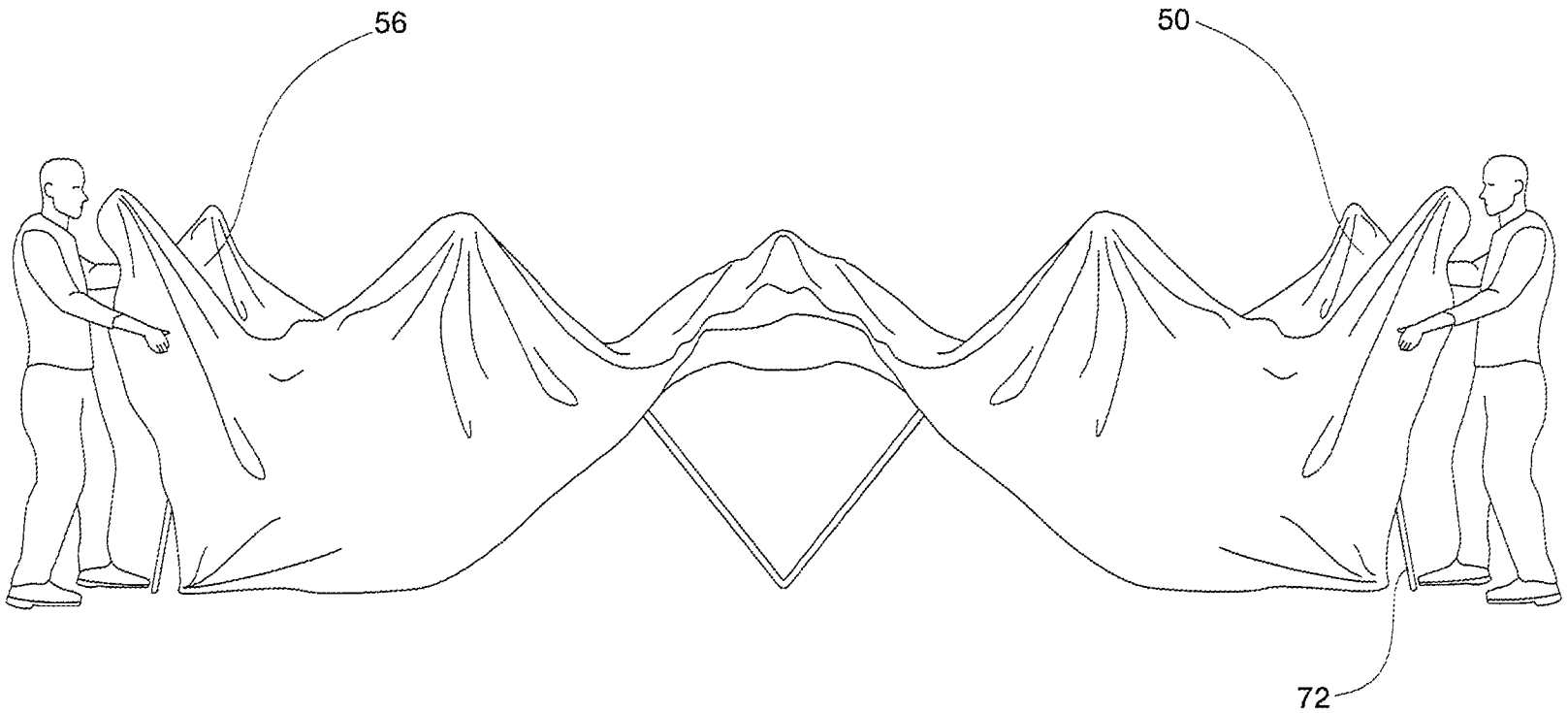
Figure 15D:
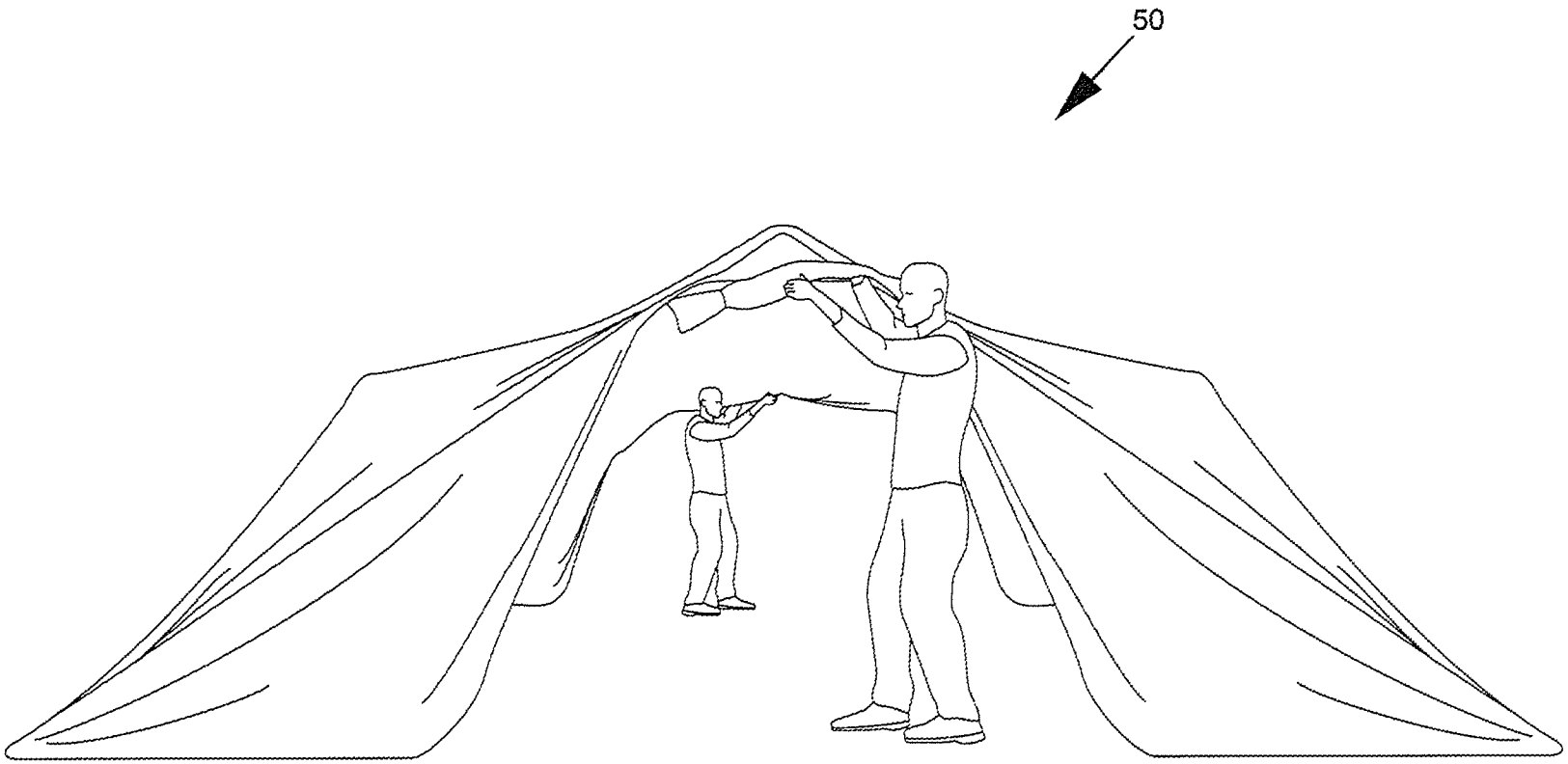
Figure 15E:
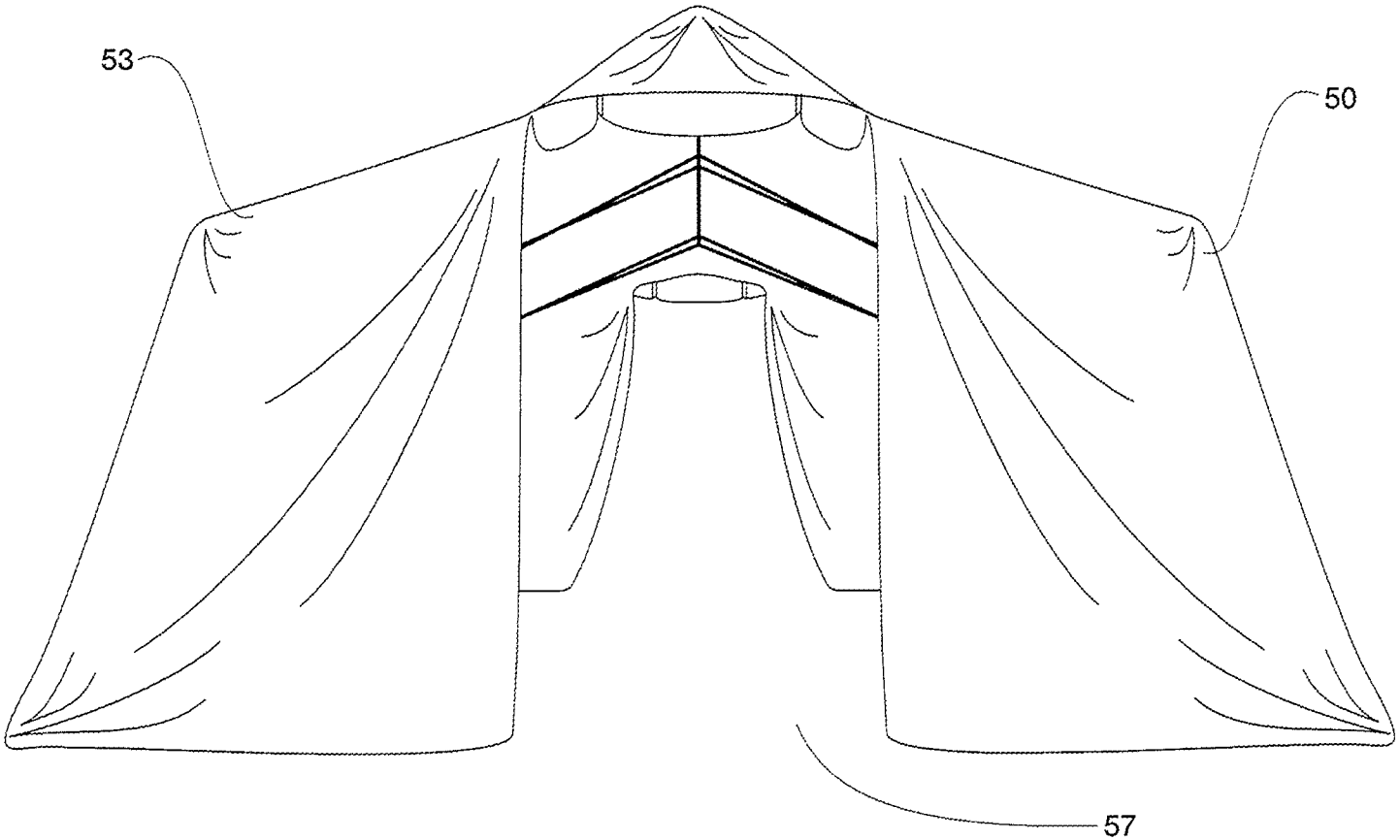
Figure 15F:
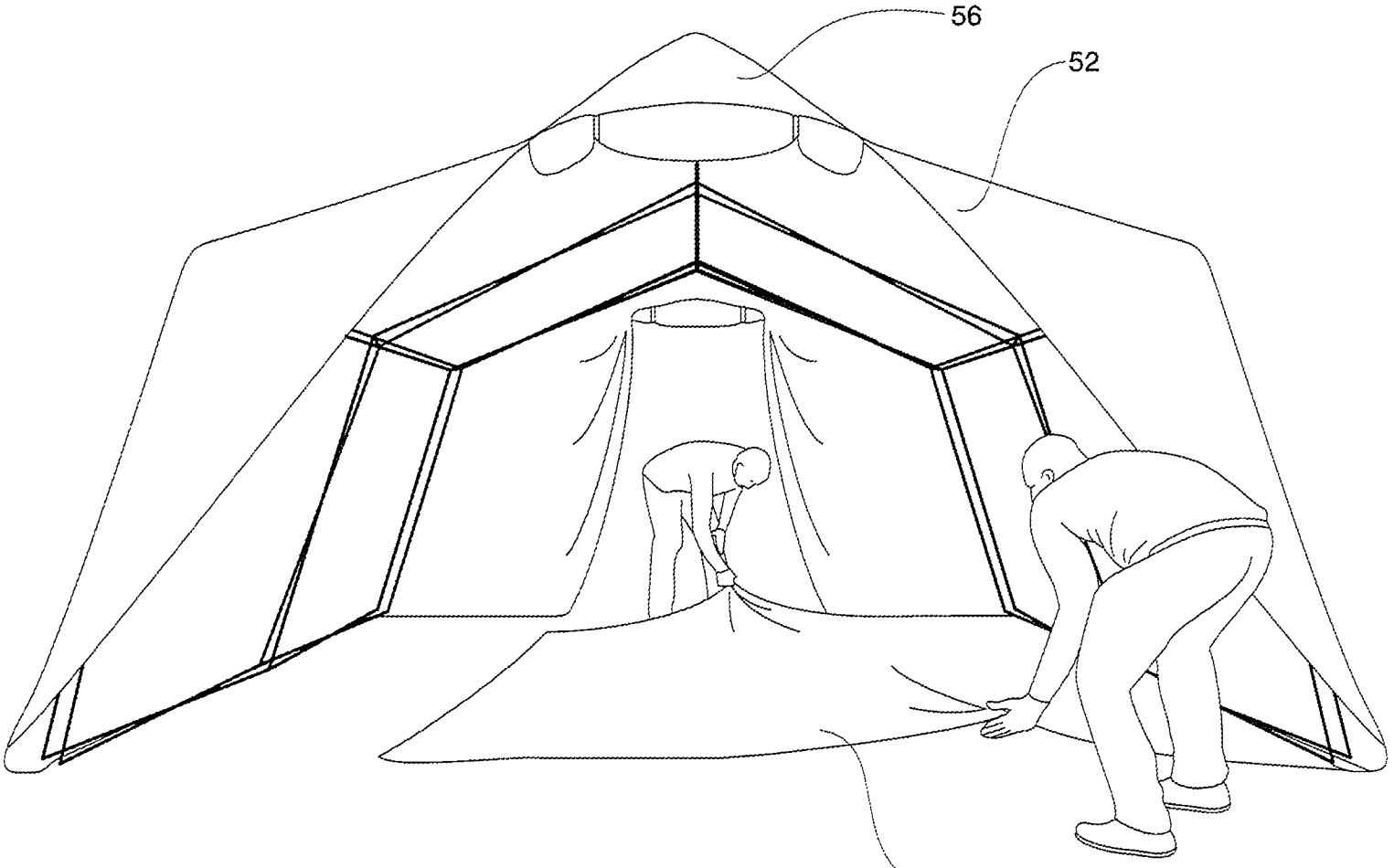
Figure 15G:
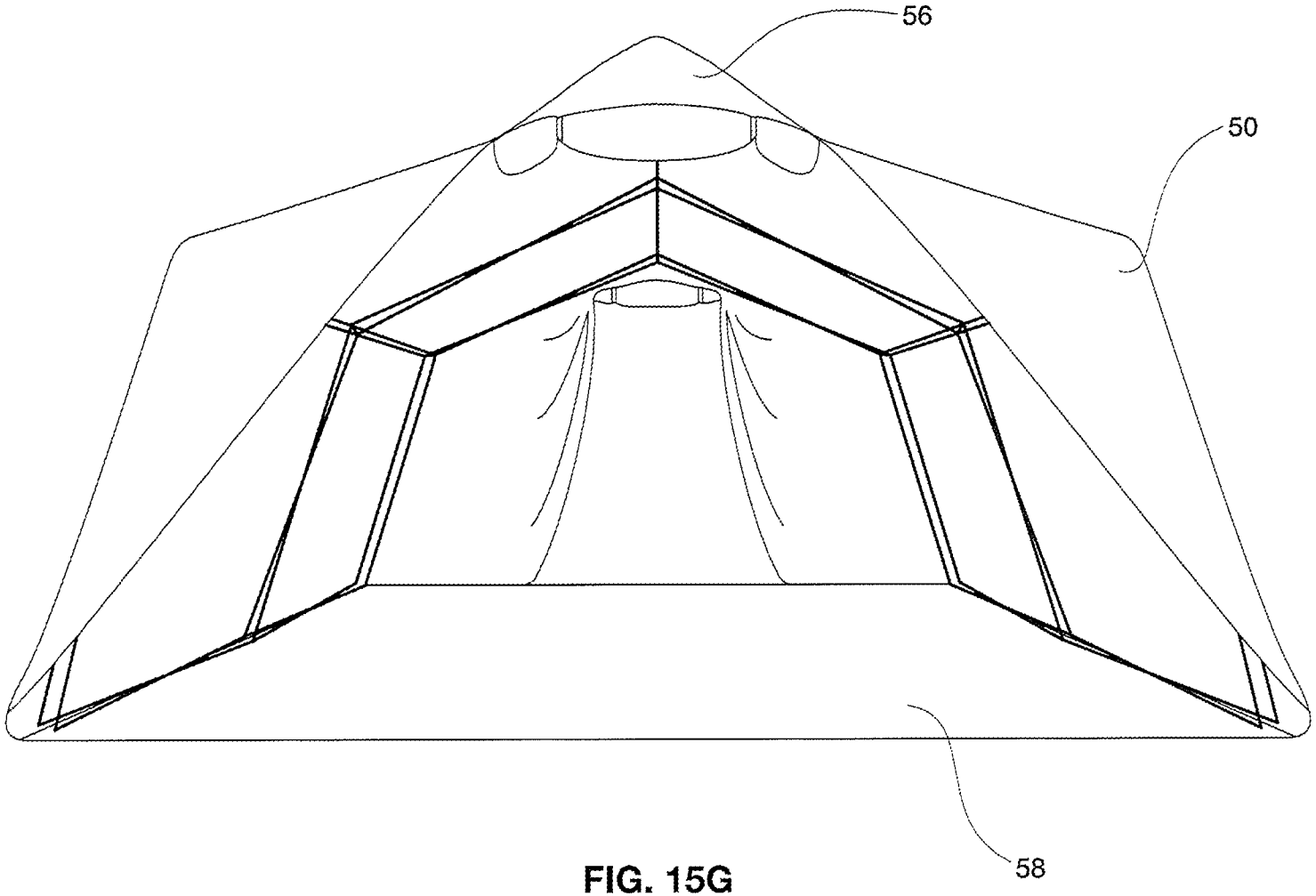

FIGS. 15A-G show a shelter system 70 in a retracted position (FIG. 15A). The shelter system may include a case 85. The case 85 may be a tough and durable material, for example, a vinyl material. The shelter may be encased in the cover for transport and storage. In use, the case is removed, and a liner may be included. In this example, the liner is removed. The shelter legs are bunched together in a substantially parallel position in the retracted position (FIG. 15B). A user may determine the end wall 59*a* and the side wall 59*b* of the retracted shelter. An end wall 59*a* may have at least 5 associated frame legs and a side wall of the shelter may have less than 5 associated legs. The shelter may be staged in its desired location. Expansion bars may be located within the frame, for example, top center bars of each wall, to be grasped and pulled apart, away from the retracted shelter on each wall end. The shelter may best, by way of example, move into the deployed position by raising the shelter slightly off the ground as the expansion bars are pulled outwardly as the articulating frame expands (FIG. 15C). The user lifts at the center point of each door end at the front and back of the shelter and the frame lifts into place, self-standing and fully deployed (FIG. 15D, 15G). A floor 58'/floor liner 58 may be added to the shelter or may be included (FIG. 15F). The floor 58 may be aligned to meet the shelter canopy side walls 59*b* and end walls 59*a*. An insulation liner 65 may be attached at the projections 30.

Other accessory items may be added to the system 70, by way of example, there may be an access panel 67, by way of example, an HVAC access panel, in the canopy at which point an HVAC duct is placed and secured in order to attach to an HVAC system. In other examples, lighting 71, power, and supplies may also be added to the shelter system. Access panels may provide interior access to units such as HVAC units that are located exterior to the shelter but are attached to interior accessories.

Figure 16A:
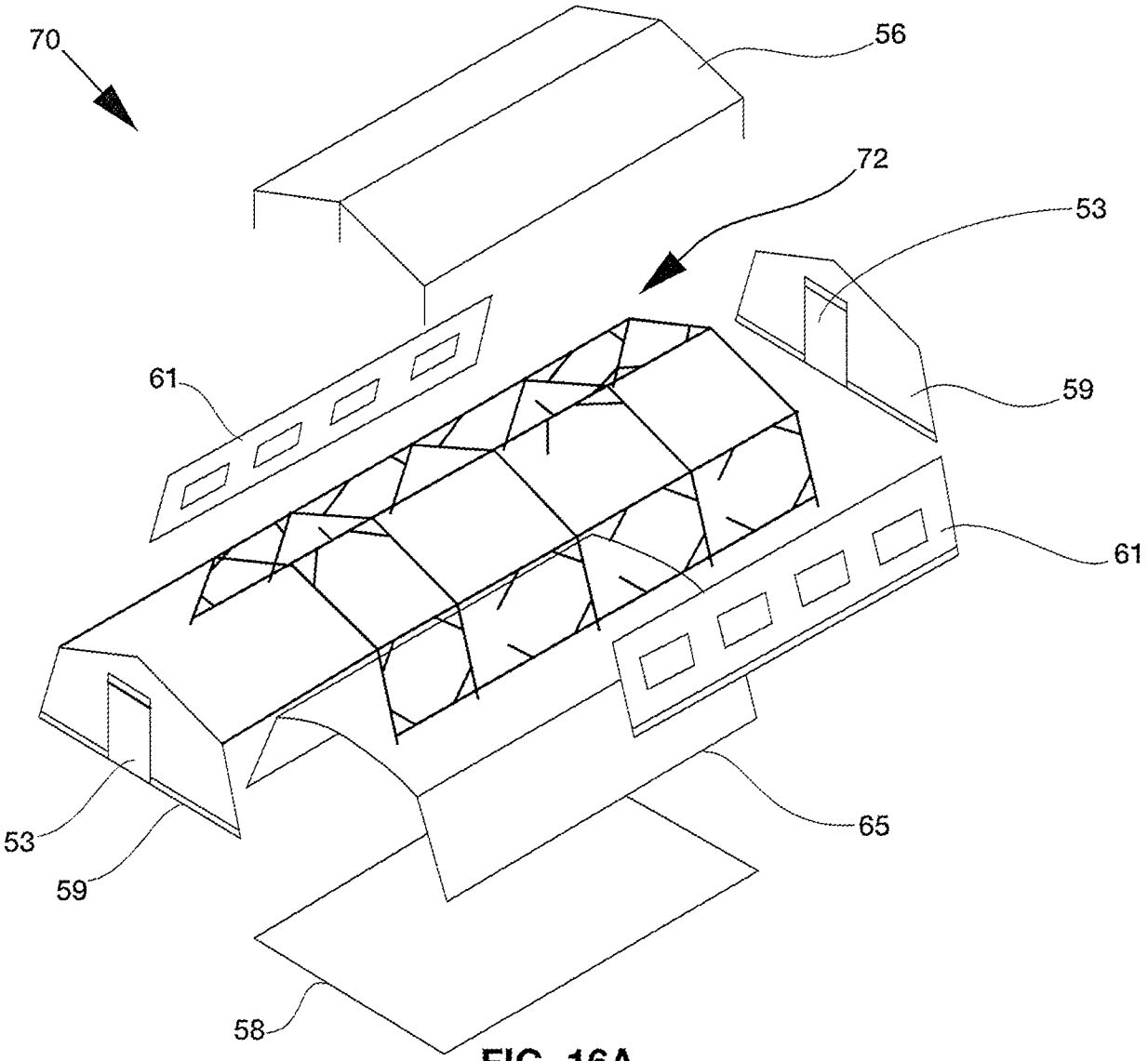
FIG. 16A-B are exploded views of one example of a shelter and shelter frame according to examples of the present disclosure.
Figure 16B:
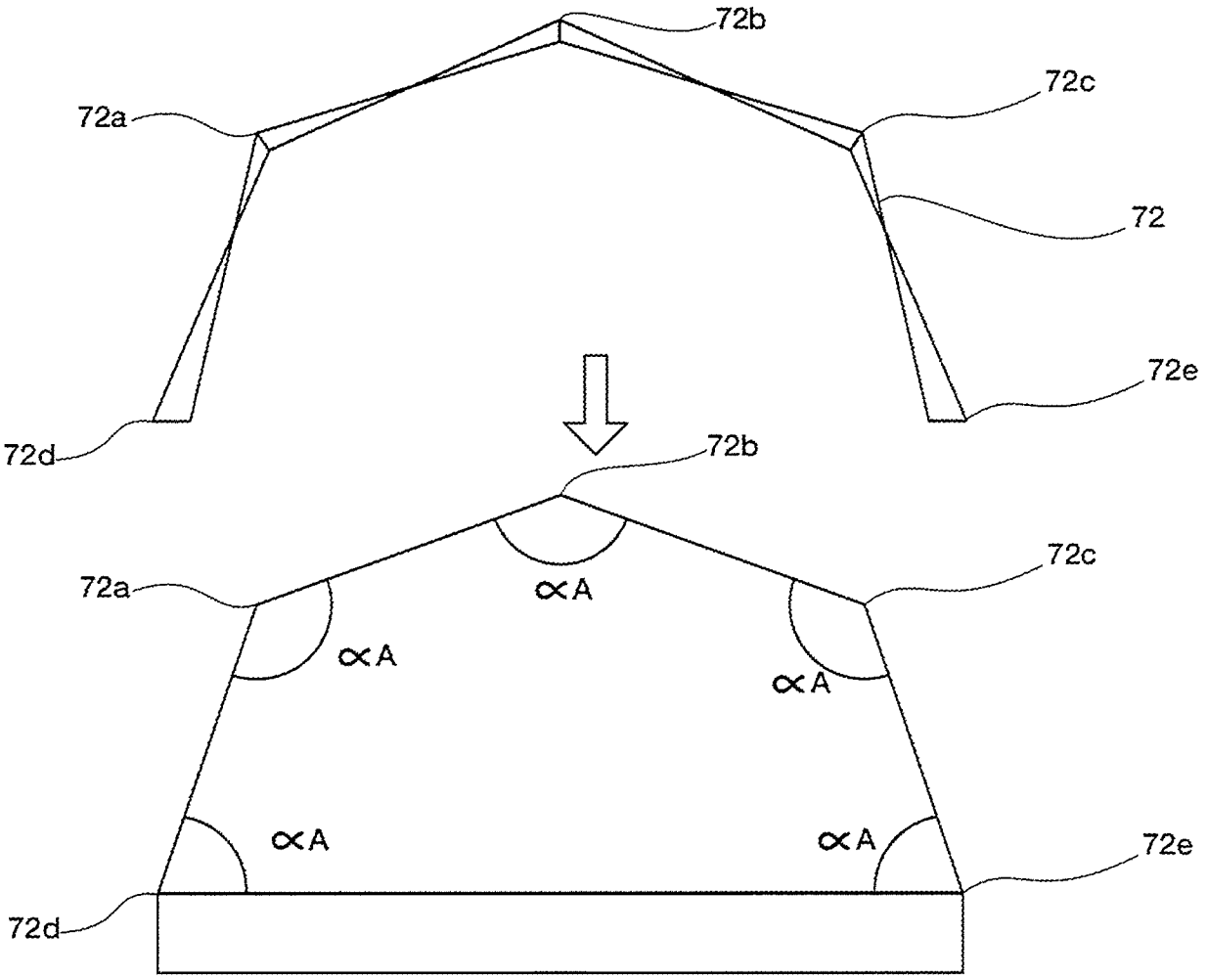
Figure 17:
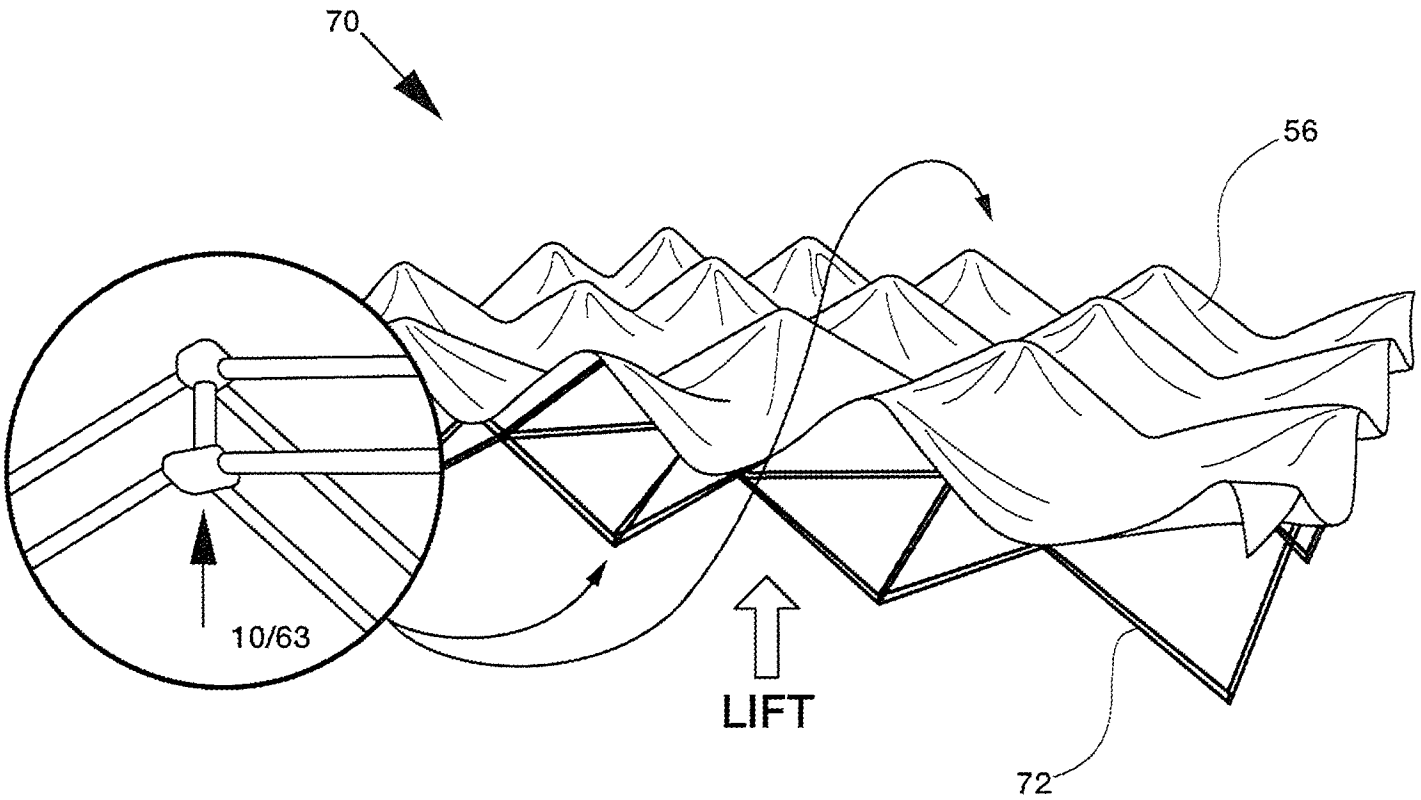
FIG. 17 is a perspective view of one example of a shelter including a hub.
Figure 18:
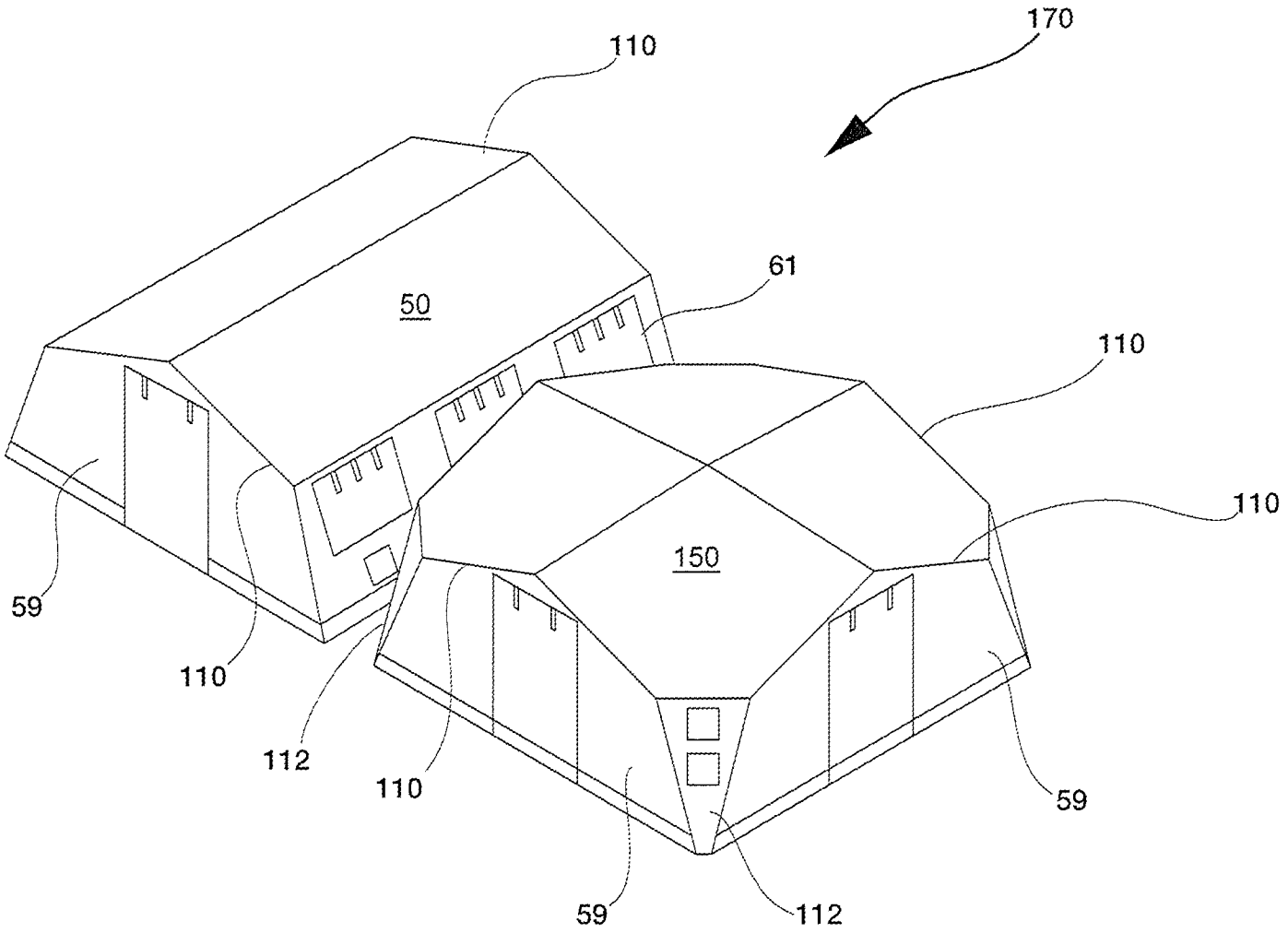
FIGS. 18-19 are perspective views of examples of a shelter system according to embodiments of the present disclosure.

In other embodiments, the inventions of the present disclosure may be considered a shelter and frame for an emergency, rapid-deployment shelter system 170. A shelter 50 may include an end wall 59 including a framework, the frame 72 forming a frame end 110 at the end wall 59. As seen in FIGS. 2, 16A, and 18, and exploded in FIG. 16B. The frame end 110 may include angles alphaA at the corners of the shelter. The angles alphaA may, in some examples include upper angles of greater than 90 degrees. In some examples, the alphaA angles in the upper angles of the shelter may between 90 degrees and 150 degrees. In some examples, the upper angles may more specifically be all above 125 degrees. Still, in other examples, the upper angle 72*b* may be greater than upper angles 72*a* and 72*c*. Upper angle 72*b* may be in some examples between 130 degrees and 145 degrees, and preferably in some examples between 135 and 140 degrees. Angles 72*a* and 72*c* may in some examples include an angle of between 125 degrees and 135 degrees, an in some examples preferably between 128 degrees and 132 degrees. Angles at legs 72*d* and 72*e* may be angles of less than angles 72*a* and 72*c*. In some embodiments, angles 72*d*, 72*e* may be between 65 degrees and 75 degrees, and more specifically in some examples, between 70 degrees and 74 degrees.

Figure 19:
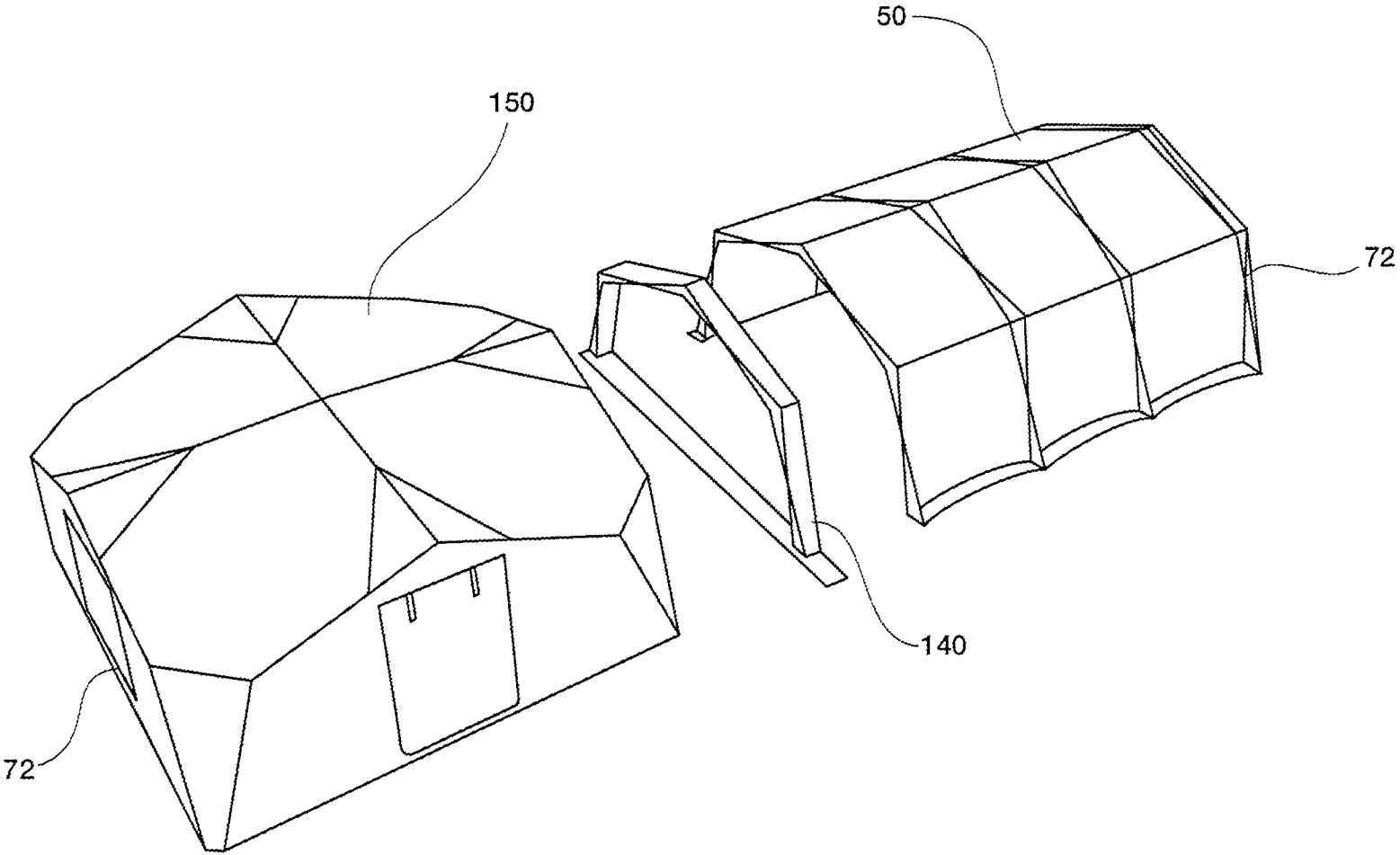
Figure 20A:
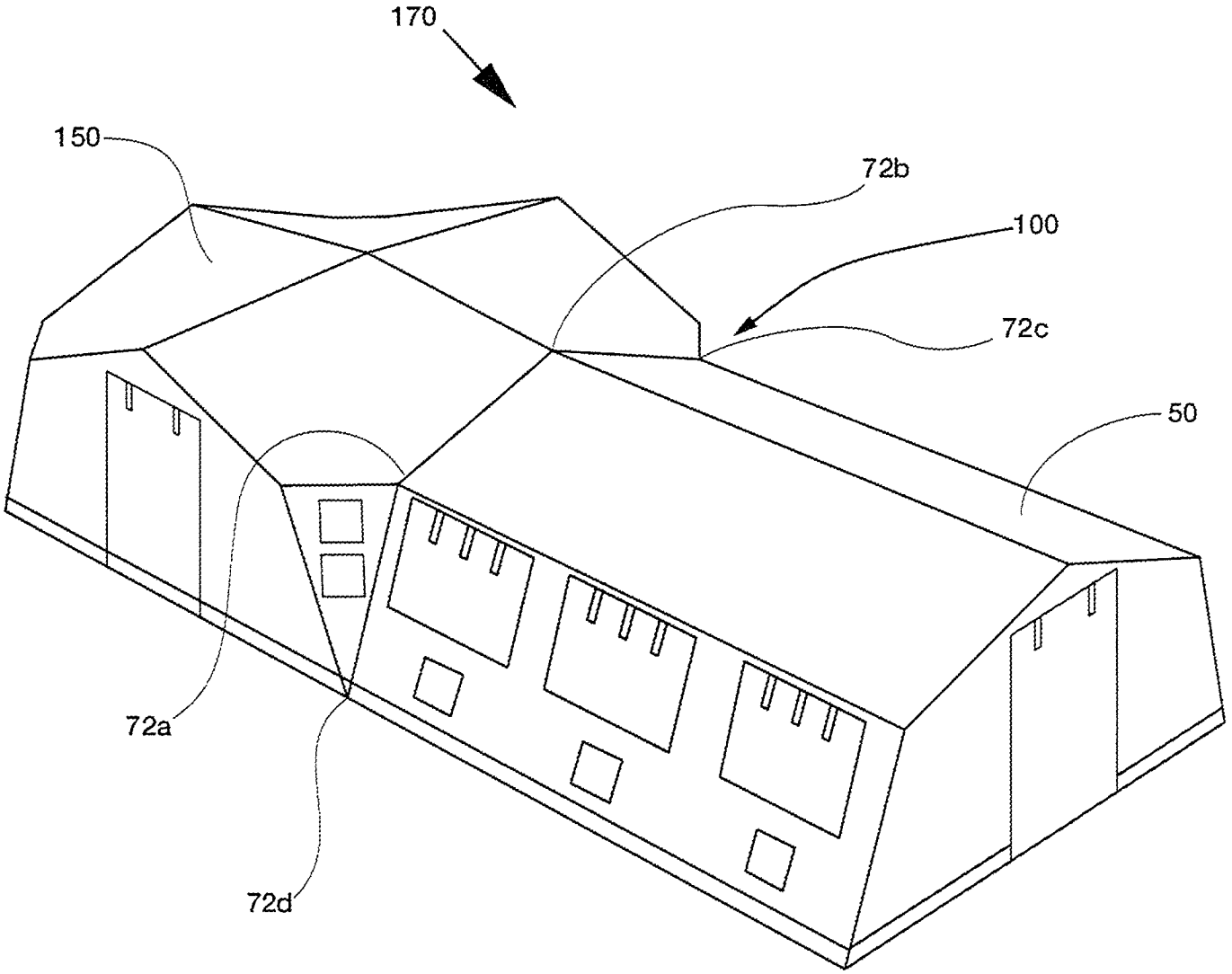
FIGS. 20A-D are perspective views of examples of shelters forming a shelter system according to embodiments of the present disclosure.
Figure 20B:
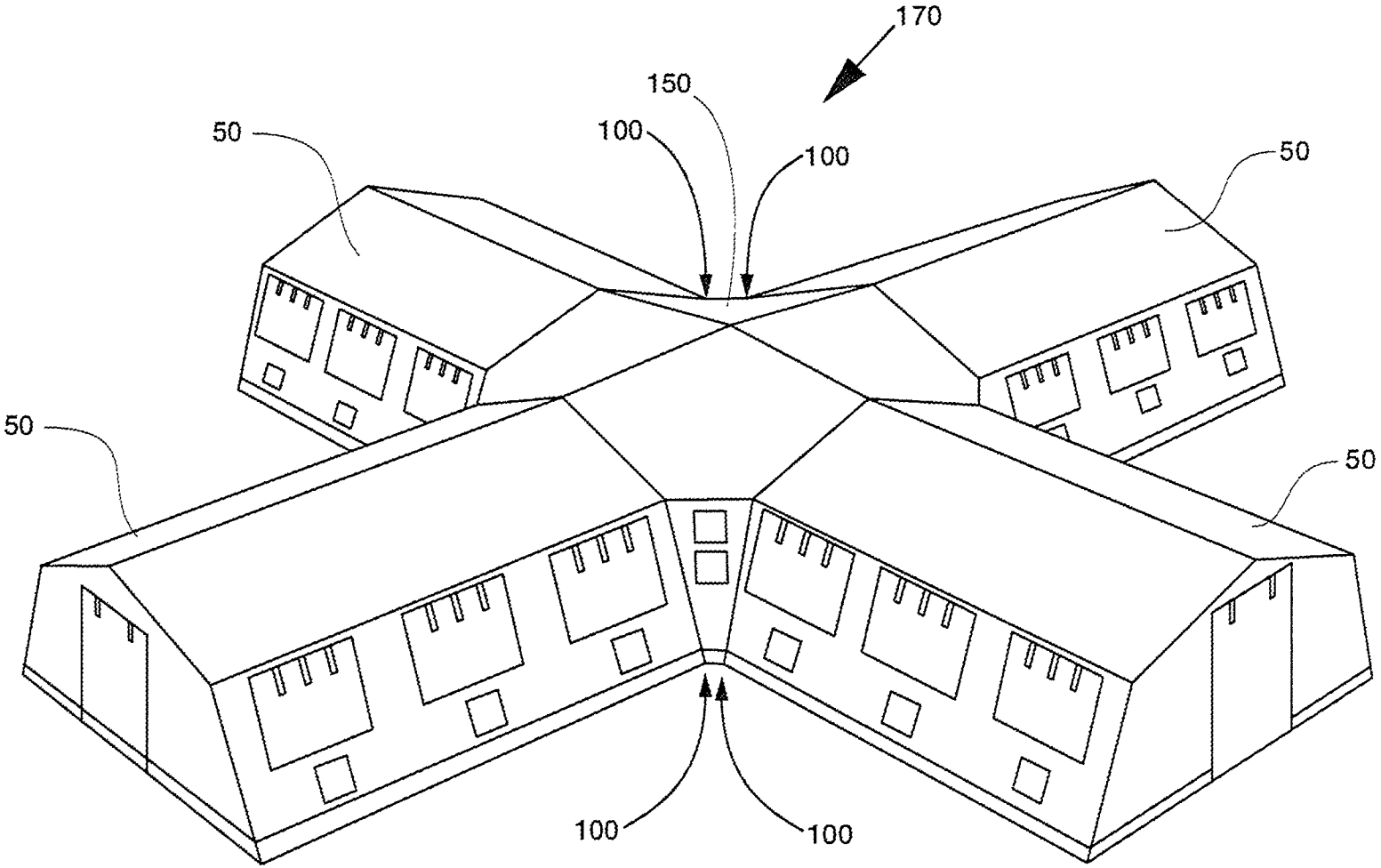
Figure 20C:
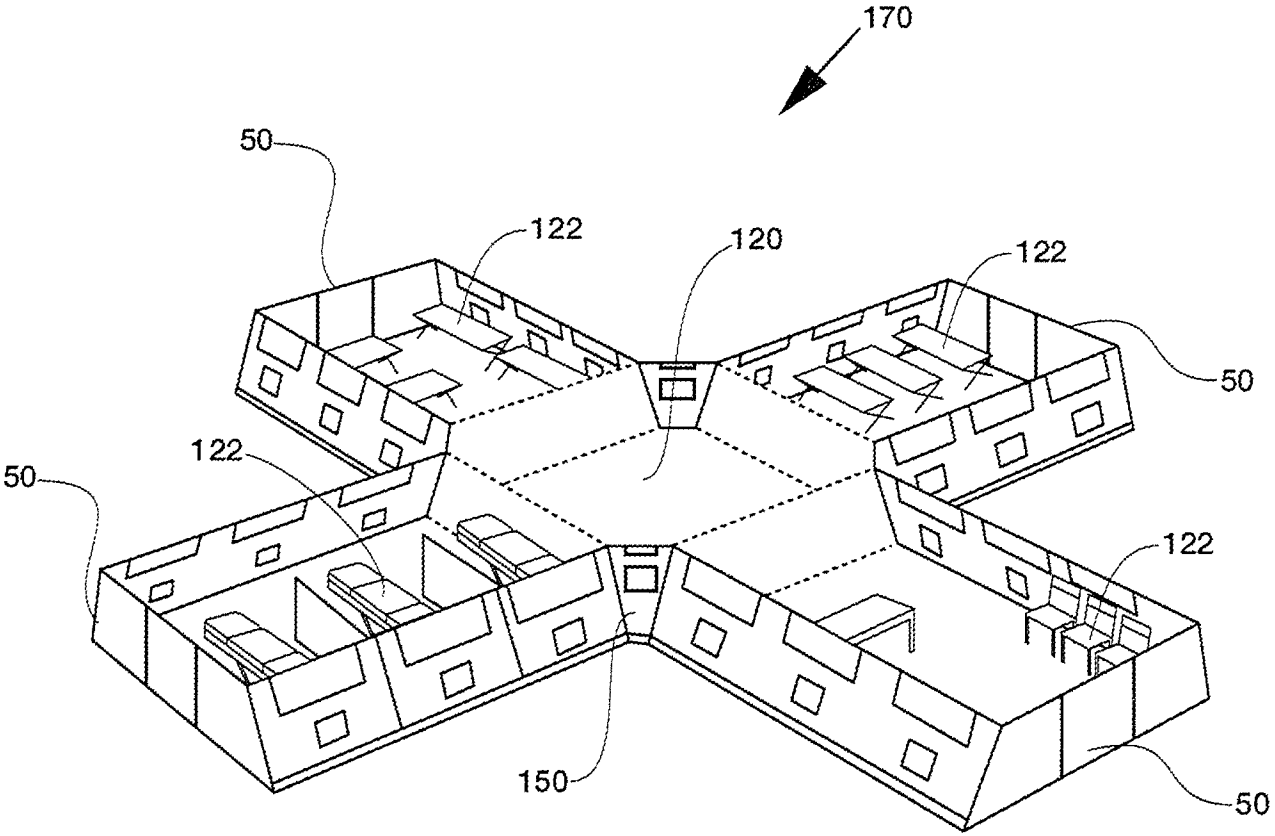
Figure 20D:
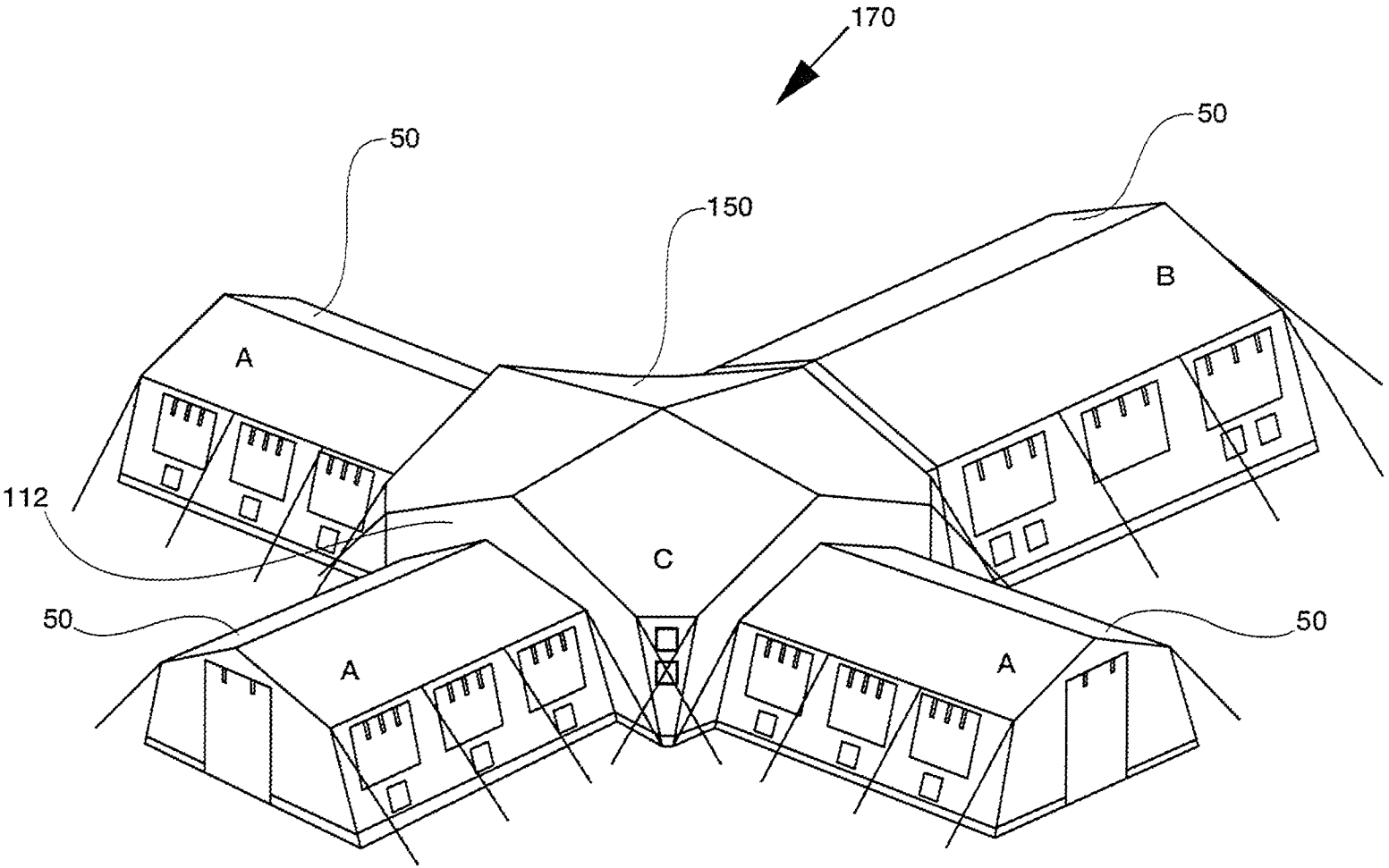

More than one shelter may be assembled frame end to frame end to form a scalable shelter complex. In this example, as shown in FIGS. 18 and 20A-D, one shelter having a frame end 110 may mate directly with another shelter having a frame end 110, ultimately interfacing the side walls of each shelter one with another with the end walls 59*a* of each removed to make a continuous inner space between the two joined shelters. In one embodiment, the two shelters, both including the frame ends may mate directly between the two frame ends 110, without requiring a vestibule or smaller opening structure between the two frame ends 110. A shelter attachment 140 may mimic the end wall 59 frame dimension and fit with the adjoining shelters to direct a water flow away from the frame ends 110 where they connect, and direct it, as a gutter away from the shelter system, see FIG. 19. In some examples, the shelter attachment 140 may assist in making a substantially waterproof connection site between two adjoining shelters.

In other examples, a shelter may include more than one end wall 59. A shelter with more than one end wall 59 may, in some example be a hub shelter 150, allowing the attachment of more than one additional shelters, and in some cases up to four additional shelters for form a shelter system 170 adaptable as a shelter complex. The hub shelter 150 may include, in some embodiments two additional end walls 59*a* in place of or incorporated into the side wall/s 59*b*. As shown in FIGS. 20A-D this configuration allows the hub shelter 150 to adjoin with other shelters, with end walls removed, without a narrowing opening between the two shelters. The hub shelter 150 also is adaptable to accommodate at least four shelter attachments to the shelter hub 150. The shelter hub 150 may include four frame ends 110 that each mate with shelters having a frame end 110. The hub shelter 150 may include a larger surface area along the end wall 59, while still mating to a frame end 110 to the frame end 110 of the adjoining shelter 50. The hub shelter 150 may include other configurations of frame end openings, including a rounded opening by way of example and mate with an adjoining shelter 70 including a frame end opening with the same dimensions so that the two shelters 150, 70 mate without a narrowing in the opening between the two shelter frame end openings. The hub shelter may include corners 112. The corners 112 may project between the shelters 50 adjoining the shelter hub 150 at the frame end openings and in the cover 56.

In other examples the inventions disclosed may be considered hub and shelter methods, for example a method for a hub, a method for a shelter system kit, a method for an improved shelter and a method for rapid deployment of a shelter according to the disclosure.

In yet another embodiment of the disclosure, included is a method for assembling a collapsed shelter 10 and securing the shelter 10 with a hub system according to any of the examples disclosed. In one example, the method may include carrying the shelter 10 collapsed, separating and/or unfolding the walls 12, expanding the shelter 10, aligning the frame of the shelter with a hub system to secure the shelter, e.g., including any of the embodiments previously shown or described. The method may also include attaching accessory items to an attachment projection 30 of a hub 10.

Portability of the shelter allows any of the shelter embodiments and examples shown and described herein to be transported to remote and difficult to reach locations, for instance because the hub and shelter components are lightweight to carry and collapsible. Often, in rapid deployment situations, shelters may be quickly set-up in a variety of environments, quickly taken-down and remain easily mobile.

Those of ordinary skill in the art having the benefit of this disclosure will recognize that any of the shelters and hub system described herein includes a variety of sizes, shapes, styles and support materials, all of which are considered within the scope of this disclosure.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A rapid-deployment shelter comprising:

a frame for supporting the shelter, where the frame is configured to alternate between a retracted position for transport and a deployed position when on location, the frame including:

a set of side wall frame poles, a set of roof frame poles, a center roof frame pole, wherein the set of side wall frame poles extend from a floor of the rapid-deployment shelter upward to interface with a roof frame pole, two of the roof frame poles interfacing at a top peak, the center roof frame pole extending lengthwise along the top peak;

a cover mating with the frame along an outside face of the frame, the cover including:

a pair of end walls, with at least one of the end walls being detachable and having a door end, a pair of side walls, with at least one of the side walls having a cover window, an angled roof, having a peak along the length of the roof, that slopes downwardly on either side of the peak toward an interface with each respective side wall, an access panel located in at least one side wall, for allowing access to an inside of the shelter for a shelter accessory that is located outside the shelter;

wherein the shelter is scalable by removing one of the end walls and attaching to a second shelter with a same shelter end wall configuration, an insulation liner that fits adjacently to the frame along an inside face of the frame, the insulation liner including an insulation liner window, wherein the insulation liner window aligns with the cover window when the insulation liner is fitted inside the frame.

2. The rapid-deployment shelter of claim 1 wherein the insulation liner attaches to the frame and the frame is fully exposed to the cover along the outside face of the frame and fully exposed to the insulation liner along the inside face of the frame.

3. The rapid-deployment shelter of claim 2 wherein the rapid-deployment shelter includes an attachment for an electrical supply inside the liner.

4. The rapid-deployment shelter of claim 1 wherein the insulation liner includes an access panel.

5. The rapid-deployment shelter of claim 4 wherein the insulation liner access panel and a side wall access panel are aligned.

6. The rapid-deployment shelter of claim 2 wherein the insulation liner hangs from with the frame.

7. The rapid-deployment shelter of claim 6 wherein the insulation liner mates with the frame on one side and the cover mates with the frame on an opposite side.

8. The rapid-deployment shelter of claim 1 including a lighting system for providing lighting inside of the insulation liner of the shelter.

9. The rapid-deployment shelter of claim 1 including an electrical system attached to an electrical supply located outside of the shelter and for providing electrical access to accessories inside of the shelter.

10. The rapid-deployment shelter of claim 1 including an anchor attached at anchoring attachment points along an exterior of the shelter.

11. The rapid-deployment shelter of claim 1 wherein the windows are retractable.

12. The rapid-deployment shelter of claim 1 wherein a frame opening includes angles formed along the frame where a set of frame poles interface.

13. The rapid-deployment shelter of claim 12 wherein the shelter frame includes at least one angular support frame pole on each of the side wall frame poles along the shelter length.

14. The rapid-deployment shelter of claim 13 wherein the frame stays assembled when folding between the retracted position for transport and the deployed position when on location.

15. The rapid-deployment shelter of claim 1 including a shelter accessory system comprising:

a lighting system inside the shelter liner.

16. The rapid-deployment shelter of claim 15 wherein the insulation liner includes further windows that are placed to align with the further cover windows of the at least one side wall.

17. The rapid-deployment shelter of claim 16 wherein the insulation liner includes access panels that are placed to align with access panels of the at least one side wall.

18. The rapid-deployment shelter of claim 15 wherein the shelter is attachable to a second shelter to form a common interior space within the shelters when the end wall of each respective shelter is removed and the shelters are adjoined one with another along a matching shelter perimeter face.

* * * * *